US008616471B2

(12) United States Patent
Short

(10) Patent No.: US 8,616,471 B2
(45) Date of Patent: Dec. 31, 2013

(54) MULTIPOINT INJECTORS WITH STANDARD ENVELOPE CHARACTERISTICS

(75) Inventor: John Earl Short, Norwalk, IA (US)

(73) Assignee: Delavan Inc, West Des Moines, IA (US)

( * ) Notice: Subject to any disclaimer, the term of this patent is extended or adjusted under 35 U.S.C. 154(b) by 246 days.

(21) Appl. No.: 13/110,371

(22) Filed: May 18, 2011

(65) Prior Publication Data

US 2012/0292408 A1 Nov. 22, 2012

(51) Int. Cl.
*B05B 1/34* (2006.01)

(52) U.S. Cl.
USPC ..... 239/463; 239/497

(58) Field of Classification Search
USPC ..... 239/463, 461, 468, 472, 497, 533.12, 239/533.14, 596
See application file for complete search history.

(56) References Cited

U.S. PATENT DOCUMENTS 3,680,793 A 8/1972 Tate et al.
5,409,169 A * 4/1995 Saikalis et al. ..... 239/404
6,533,954 B2 3/2003 Mansour et al.
6,755,024 B1 6/2004 Mao et al.
6,854,670 B2 * 2/2005 Sumisha et al. ..... 239/543
7,926,178 B2 4/2011 Thomson et al.
2011/0031333 A1 2/2011 Short

FOREIGN PATENT DOCUMENTS

EP 1193450 A1 4/2002

* cited by examiner

*Primary Examiner* — Davis Hwu

(74) *Attorney, Agent, or Firm* — Edwards Wildman Palmer LLP; Scott D. Wofsy; Joshua L. Jones

(57) ABSTRACT

A multipoint injector ring includes a distributor ring defining a central axis and having a fluid inlet and a plurality of swirlers in fluid communication with the fluid inlet for imparting swirl on fluid from the fluid inlet. The swirlers are defined in a downstream surface of the distributor ring. An orifice ring is mounted to the distributor ring. The orifice ring defines a plurality of fluid outlets circumferentially spaced apart with respect to the central axis. Each fluid outlet is aligned downstream of a respective swirler for injecting swirling fluid from the swirlers in a downstream direction.

6 Claims, 26 Drawing Sheets

Fig. 7
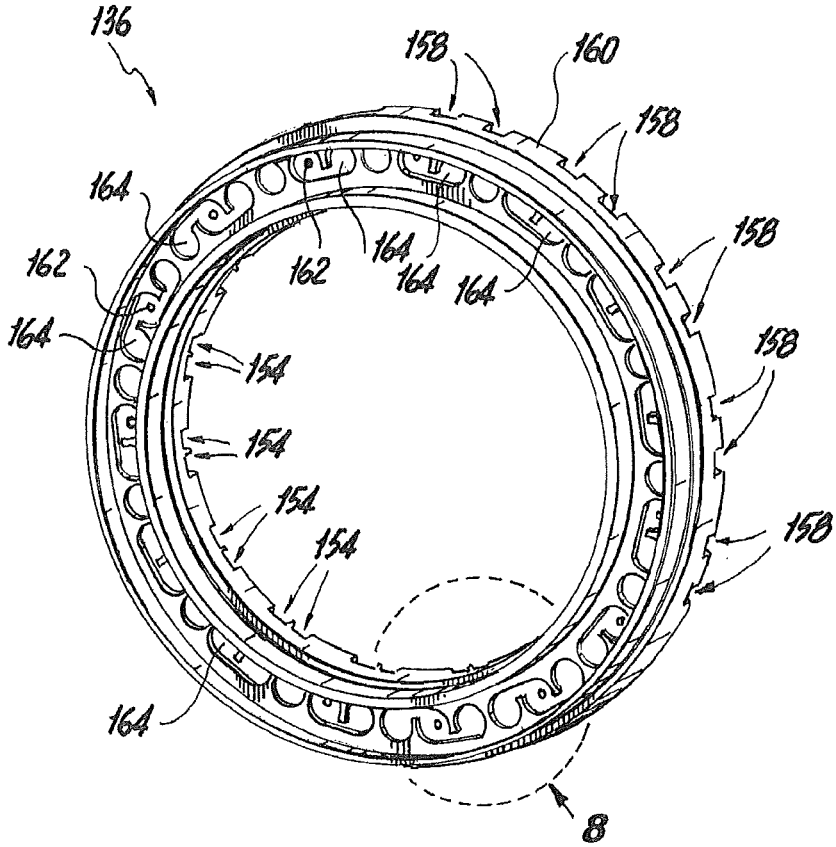
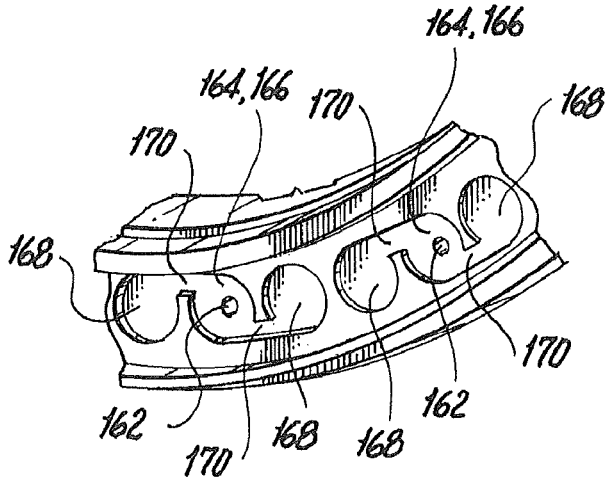
Fig. 8

Fig. 47
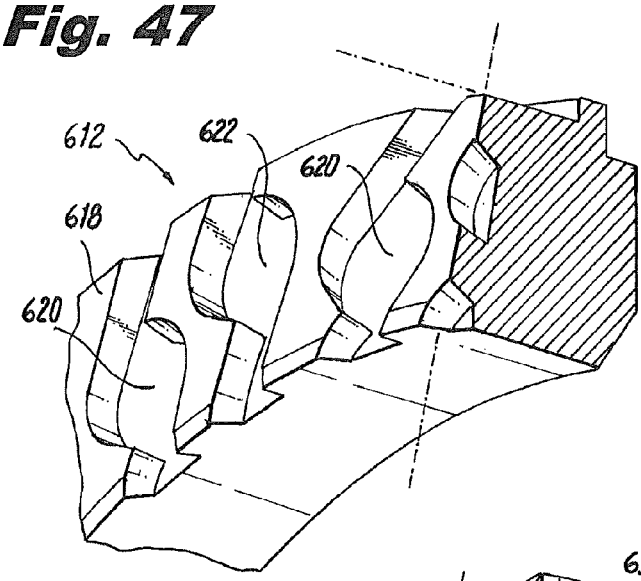
Fig. 48
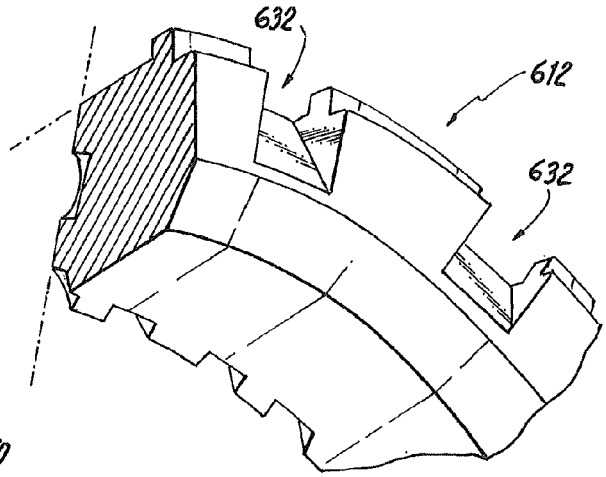
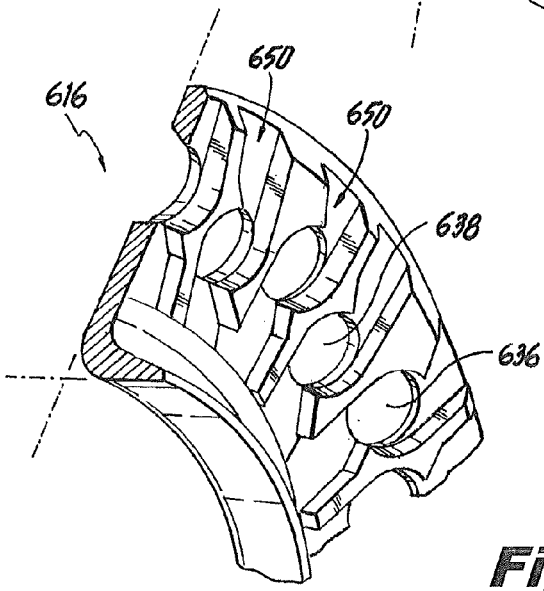
Fig. 49

MULTIPOINT INJECTORS WITH STANDARD ENVELOPE CHARACTERISTICS

BACKGROUND OF THE INVENTION

1. Field of the Invention

The present invention relates to injectors and nozzles, and more particularly to injectors and nozzles for atomizing liquids.

2. Description of Related Art

The drive for cleaner, quieter, and more efficient aircraft has created a demand to develop lean burn jet engines, where most of the combustion air enters the combustor via the fuel injectors. Lean burning combustion creates leaner, lower temperature flames, which reduces the $NO_x$ emissions and improves fuel efficiency. However, maintaining stability over the entire power curve can be a challenge in lean burning engines, especially at low power conditions. The fuel injection process becomes extremely critical at low power conditions, where fuel and air must be mixed very rapidly to achieve flow patterns that yield a stable flame.

Numerous fuel injection methods have been examined with an aim to advancing the art of lean burn technologies. Two such fuel injection methods include Lean Direct Injection and Lean Premixed Pre-vaporized Injection. Lean Direct Injection (LDI) introduces liquid fuel directly into the flame zone as opposed to Lean Premixed Pre-vaporized Injection (LPP), where fuel is mixed with air and vaporized upstream of the flame zone. While LPP provides excellent mixing, its implementation is complicated by auto-ignition and flashback into the premixing region. These complications have steered increasing interest toward LDI as a superior injection method because it avoids premature ignition by mixing air and liquid droplets directly in the combustion zone.

In researching LDI technologies, NASA has conducted in-depth research on a number of multipoint LDI fuel injectors including injectors having nine, twenty-five, thirty-six, and forty-nine individual injection points in a flame tube combustor and a sector rig. All of these configurations have demonstrated the ability of multipoint injection to dramatically reduce $NO_x$ emissions. A similar multipoint injector having a square, thirty-six injection point array is described in U.S. Pat. No. 6,533,954 to Mansour et al.

The multipoint injectors that have been investigated by NASA and others have generally employed flat, rectangular arrays of injection points. Swirling air is introduced around each injection point, producing small, individual recirculation zones for flame anchoring. Although tests of these multipoint injectors have shown some promise in reducing emissions, there is still a need to improve the stability. Moreover, most medium and large gas turbine engines in use employ air blast injectors. In these designs, fuel is deployed as a conical sheet and is broken up into droplets as it is sheared by inlet air that is accelerated by concentric swirlers. A central recirculation zone created by the large air swirlers serves to anchor the flame and provide stability. The multipoint injectors of NASA and others described above are not conducive to operating in the same physical envelope as traditional air blast injectors, especially with respect to providing the volume of airflow and dominant aerodynamic structure for flame anchoring, typical of air blast injectors.

Such conventional methods and systems have generally been considered satisfactory for their intended purpose. However, there is still a need in the art for LDI multipoint injectors that allow for improved flame stabilization. There also remains a need in the art for such injectors that can be used in traditional injector envelopes within gas turbine engines. The present invention provides a solution for these problems.

SUMMARY OF THE INVENTION

The subject invention is directed to a new and useful multipoint injector ring. The multipoint injector ring includes a distributor ring defining a central axis and having a fluid inlet and a plurality of swirlers in fluid communication with the fluid inlet for imparting swirl on fluid from the fluid inlet. The swirlers are defined in a downstream surface of the distributor ring. An orifice ring is mounted to the distributor ring. The orifice ring defines a plurality of fluid outlets circumferentially spaced apart with respect to the central axis. Each fluid outlet is aligned downstream of a respective swirler for injecting swirling fluid from the swirlers in a downstream direction.

In accordance with certain embodiments, a fuel circuit is defined from the fluid inlet, through the swirlers to the fluid outlets. The swirlers and fluid outlets are configured and adapted to inject a swirling, pressure atomized spray of fuel therefrom. An air swirler ring can be mounted proximate the orifice ring, wherein the air swirler ring defines a plurality of air swirlers in an upstream facing surface thereof. An air outlet can be defined through the air swirler ring in fluid communication with each respective air swirler. Each air outlet can be aligned downstream of a respective fluid outlet of the orifice ring to impart swirl on a flow of air to assist atomization of fuel from each fluid outlet. The air swirler ring can include an inboard air inlet in fluid communication with the air swirlers for providing a flow of air from a radially inboard source, and/or the air swirler ring can include an outboard air inlet in fluid communication with the air swirlers for providing a flow of air from a radially outboard source.

In certain embodiments, an air circuit is defined from the fluid inlet, through the swirlers to the fluid outlets. The multipoint injector ring can further include a fuel circuit including a plurality of fuel swirl chambers defined in an upstream surface of the distributor ring for imparting swirl onto a flow of fuel passing therethrough. A fuel outlet orifice can be provided in fluid communication with each respective fuel swirl chamber, with each fuel outlet orifice passing through the distributor ring from the respective fuel swirl chamber to a downstream surface of the distributor ring. Each fuel outlet orifice can be aligned with a respective one of the swirlers of the air circuit for injecting a swirling flow of fuel and air for air-assisted injection of fuel.

The invention also provides a fuel injector. The fuel injector includes an outer fuel sleeve defining a longitudinal central axis and having a fuel inlet defined therein for receiving fuel from an external source. An inner fuel sleeve is mounted inboard of the outer fuel sleeve with the inner and outer fuel sleeves forming an injector body. A fuel passage is defined between the outer and inner fuel sleeves. The fuel passage places the fuel inlet in fluid communication with a plurality of fuel outlets defined in the injector body. A distributor ring is mounted to the injector body having a plurality of fuel inlets aligned with respective fuel outlets of the inner fuel sleeve. The distributor ring includes a plurality of fuel swirlers, each in fluid communication with a respective fuel inlet of the distributor ring, for imparting swirl on fuel passing through the distributor ring. The fuel swirlers are defined in an upstream surface of the distributor ring, and each fuel swirler includes a spray orifice defined through the distributor ring for injecting a swirling spray of fuel therefrom.

An air body ring is mounted downstream of the distributor ring. The air body ring defines a plurality of air outlets therethrough circumferentially spaced apart with respect to the central axis. A plurality of air swirlers are defined between the distributor ring and the air body ring. Each air swirler is aligned with a respective air outlet, and each air outlet is aligned downstream of a respective spray orifice for injecting a swirling flow of fuel and air for air-assisted injection of fuel.

In accordance with certain embodiments, the air swirlers are defined in a downstream face of the distributor ring, and each air swirler includes at least one inboard air inlet in fluid communication therewith defined in a radially inboard surface of the distributor ring. Each air swirler also includes at least one outboard air inlet in fluid communication therewith defined in a radially outboard surface of the distributor ring. Each of the air inlets of the air swirlers can be radially off set with respect to the respective spray orifice thereof to form a radial air swirler about the respective spray orifice. It is also contemplated that the air swirlers can be defined in an upstream face of the air body ring. It is also contemplated that each air outlet of the air body ring can include an aerodynamically angled downstream surface configured to be aerodynamically wiped to resist carbon formation thereon.

The fuel inlet of the outer fuel sleeve can include separate fuel circuit inlets, each in fluid communication with a separate one of a plurality of fuel circuits defined through the injector body. Each fuel circuit can be in fluid communication with a separate, fluidly isolated subset of the fuel swirlers for separate staging of fuel flow through the plurality of fuel circuits.

In certain embodiments, the injector body includes a first fuel circuit that includes an axial channel defined in a radially outer surface of the inner fuel sleeve in fluid communication with a circumferential channel defined in the radially outer surface of the inner fuel sleeve for distributing fuel around the distributor ring to a first subset of the fuel inlets thereof. The injector body can include a second fuel circuit that has an axial channel defined in the radially outer surface of the inner fuel sleeve in fluid communication with a circumferential channel defined in the radially inner surface of the outer fuel sleeve for distributing fuel around the distributor ring to a second subset of the fuel inlets thereof.

The invention also provides a fuel injector having a fuel orifice ring. The fuel injector includes inner and outer fuel sleeves as described above. A fuel swirler ring is mounted to the injector body having a fluid inlet in fluid communication with a fuel outlet of the injector body formed by the inner and outer fuel sleeves. The fuel swirler ring includes a plurality of fuel swirlers in fluid communication with the fluid inlet for imparting swirl on fuel from the fluid inlet. The fuel swirlers are defined in a downstream surface of the fuel swirler ring. A fuel orifice ring is mounted to the fuel swirler ring with the fuel orifice ring defining a plurality of fuel outlet orifices circumferentially spaced apart with respect to the central axis. Each fuel outlet orifice is aligned downstream of a respective fuel swirler for injecting a swirling spray of fuel from the fuel swirlers in a downstream direction.

In accordance with certain embodiments, the fuel injector can include an air swirler ring mounted to the fuel orifice ring. The air swirler ring includes a plurality of spray outlets defined therethrough, each spray outlet being aligned with a respective one of the fuel outlet orifices. A plurality of air swirlers are defined in an upstream surface of the air swirler ring, each air swirler being in fluid communication with a respective one of the spray outlets for injecting a swirling flow of fuel and air for air-assisted injection of fuel.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 7 is a perspective view of the distributor ring of FIG. 6*a*, showing the fuel swirlers in the upstream face of the distributor ring;

FIG. 8 is a perspective view of a portion of the distributor ring of FIG. 7, showing an enlarged view of two of the fuel swirlers;

FIG. 47 is a cross-sectional perspective view of a portion of the fuel injector of FIG. 46, showing a section of the distributor ring as viewed from downstream;

FIG. 48 is a cross-sectional perspective view of a portion of the fuel injector of FIG. 46, showing a section of the distributor ring as viewed from upstream; and FIG. 49 is a cross-sectional perspective view of a portion of the fuel injector of FIG. 46, showing a section of the air swirler ring.

DETAILED DESCRIPTION OF THE PREFERRED EMBODIMENTS

Figure 1:
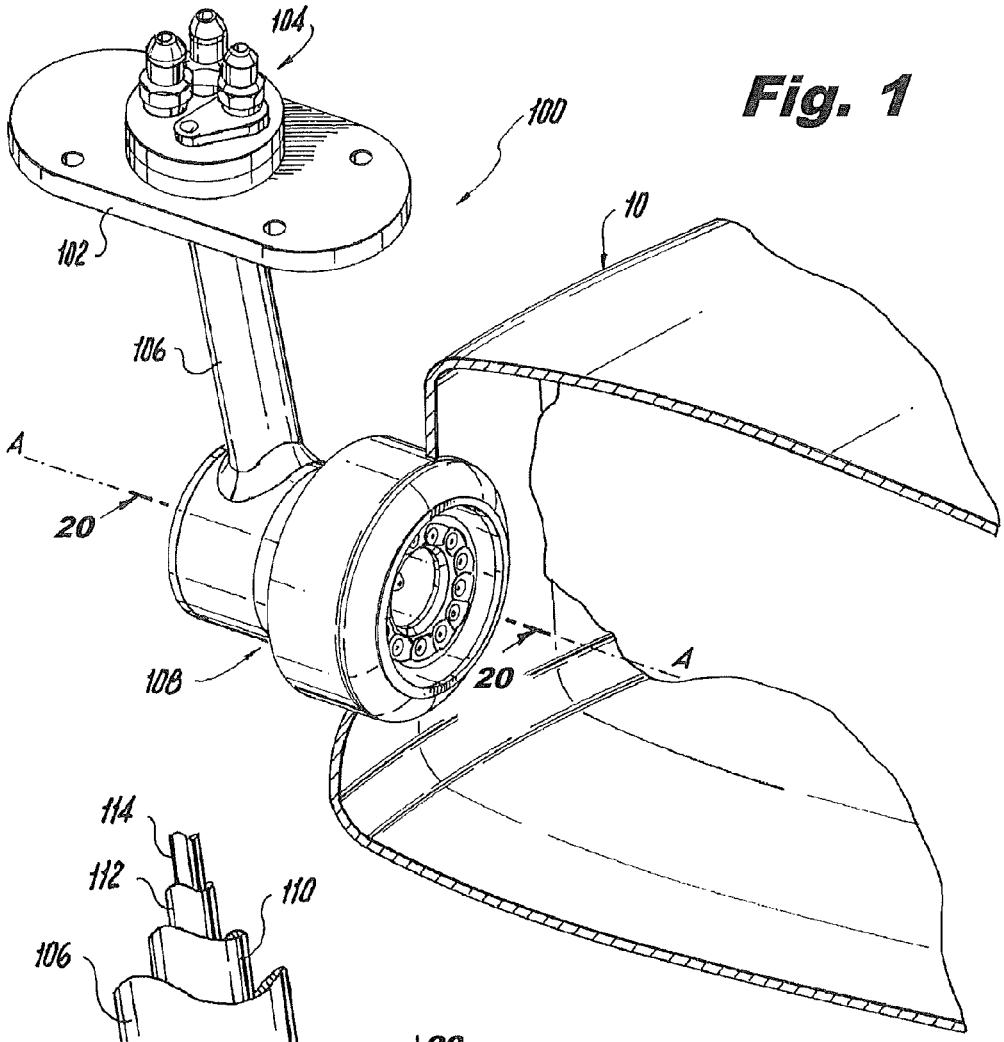
FIG. 1 is a perspective view of an exemplary embodiment of an injector constructed in accordance with the present invention, showing the injector in a combustor that is partially cut away.

Reference will now be made to the drawings wherein like reference numerals identify similar structural features or aspects of the subject invention. For purposes of explanation and illustration, and not limitation, a partial view of an exemplary embodiment of a multipoint injector in accordance with the invention is shown in FIG. 1 and is designated generally by reference character 100. Other embodiments of multipoint injectors in accordance with the invention, or aspects thereof, are provided in FIGS. 2-45, as will be described. The systems and methods of the invention can be used to provide multipoint swirl stabilized discrete injection atomization, with particular applications in lean direct injection, to improve flame stabilization. In the exemplary embodiments described herein, the benefits of multipoint injection are added to the benefits of the stability provided by a central recirculation zone as in airblast injectors, rather than on numerous distributed zones as in traditional multipoint injection systems.

Referring now to FIG. 1, injector 100 includes a mounting flange 102 with associated inlet fittings 104 for connecting injector 100 with a fuel source, such as fuel lines in a gas turbine engine. Feed arm 106 structurally connects between mounting flange 102 and nozzle body 108, and places inlet fittings 104 in fluid communication with nozzle body 108. Nozzle body 108 of injector 100 is mounted in an upstream wall of combustor 10 to issue a flow of fuel and air for combustion therein.

Figure 2:
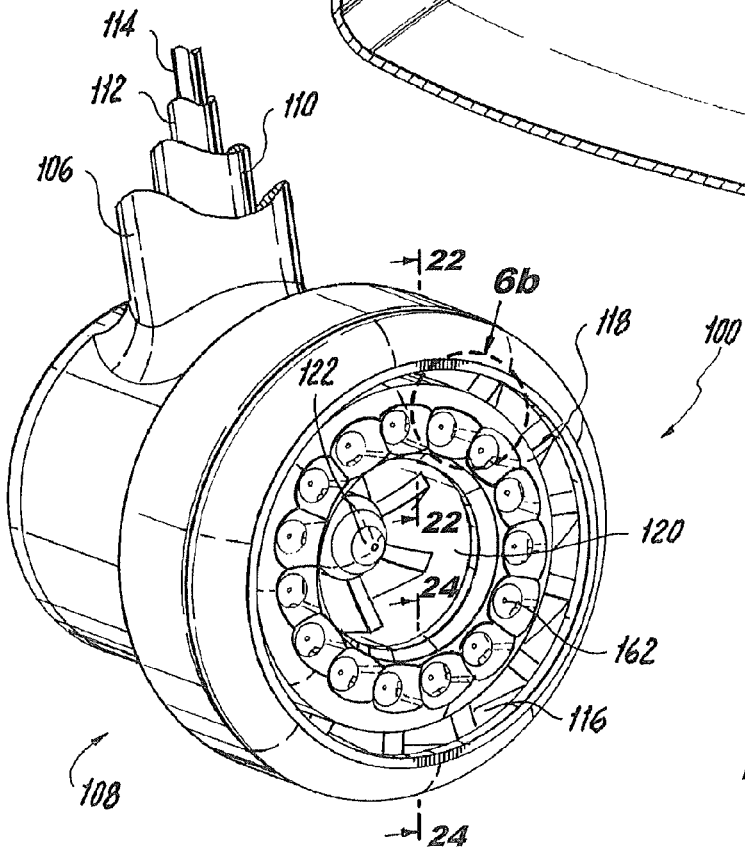
FIG. 2 is a cut-away perspective view of a portion of the injector of FIG. 1, showing the outlets of the multipoint injector ring.

With reference now to FIG. 2, nozzle body 108 is shown in greater detail. Feed arm 106 includes three concentric fuel conduits 110, 112, and 114, each of which conducts fuel from one of the inlet fittings 104 to a respective one of three fuel circuits or stages, which are described in greater detail below. The components of nozzle body 108 generally form an outer air swirler 116, multipoint injection ring 118, an inner air swirler 120, and an inner fuel injector 122.

Figure 3:
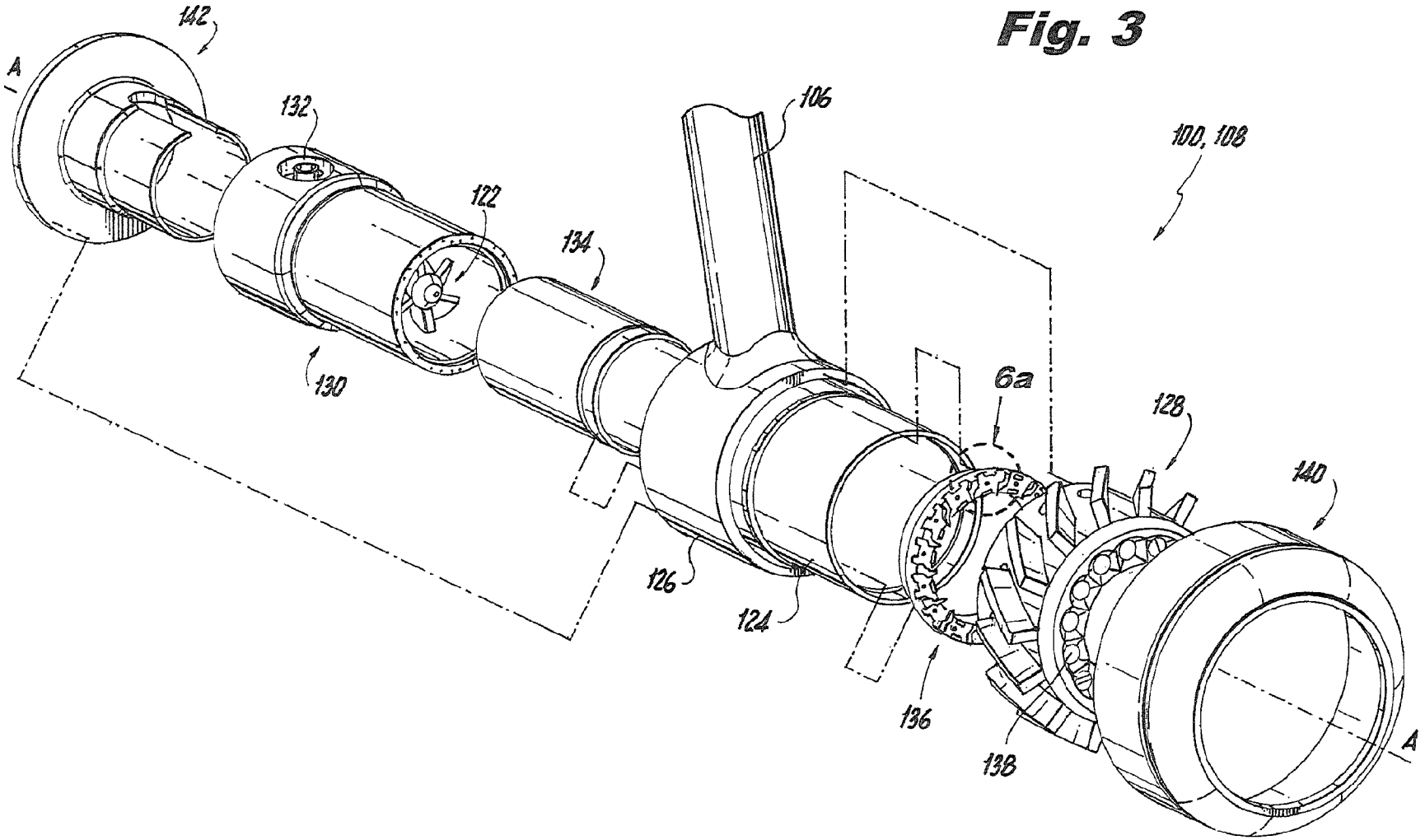
FIG. 3 is an exploded perspective view of a portion of the injector or FIG. 1, showing the multipoint injector ring components separated from one another.

Referring now to FIG. 3, the individual components of nozzle body 108 are shown separated from one another. A downstream portion of feed arm 106 forms an outer heat shield 124, and an upstream portion 126 of outer heat shield 124 forms an exterior of nozzle body 108. Air body 128 is mounted downstream of the upstream portion 126 of outer heat shield 124, and is radially outboard of the downstream portion thereof.

A fuel injector body 130 defines a longitudinal central axis A and has a fuel inlet 132 defined therein for receiving fuel from an external source. Fuel injector body 130 includes an inner fuel sleeve mounted inboard of an outer fuel sleeve, as described below with reference to FIG. 9. Fuel passages are defined between the outer and inner fuel sleeves of the injector body as described in greater detail below.

With continued reference to FIG. 3, a distributor ring 136 is mounted to the downstream end of injector body 130. Distributor ring 136 includes a plurality of fuel inlets aligned with respective fuel outlets of fuel injector body 130, as described in greater detail below with reference to FIGS. 18-19. Distributor ring 136 includes a plurality of fuel swirlers defined in an upstream surface thereof, and a plurality of air swirlers defined in a downstream surface thereof, as described in greater detail below. Each of the fuel and air swirlers is positioned to impart swirl on an individual spray point, and together the multiple spray points form a multipoint injector ring.

Air body 128 is in the general form of a ring is mounted outboard of outer heat shield 124, with its downstream portion wrapping around the downstream facing portion of distributor ring 136. Air cap 140 is mounted to air body 128 to form outer air swirler 116 of nozzle body 108 (shown in FIG. 2). Upstream inner heat shield 142 is mounted to the upstream end of nozzle body 108 inboard of fuel injector body 130. A downstream inner heat shield 134 is mounted inboard of injector body 130. Together, upstream and downstream inner heat shields 142 and 134 form a portion of inner air swirler 120 (shown in FIG. 2) and provide thermal shielding for fuel passing through injector body 130.

Figure 4:
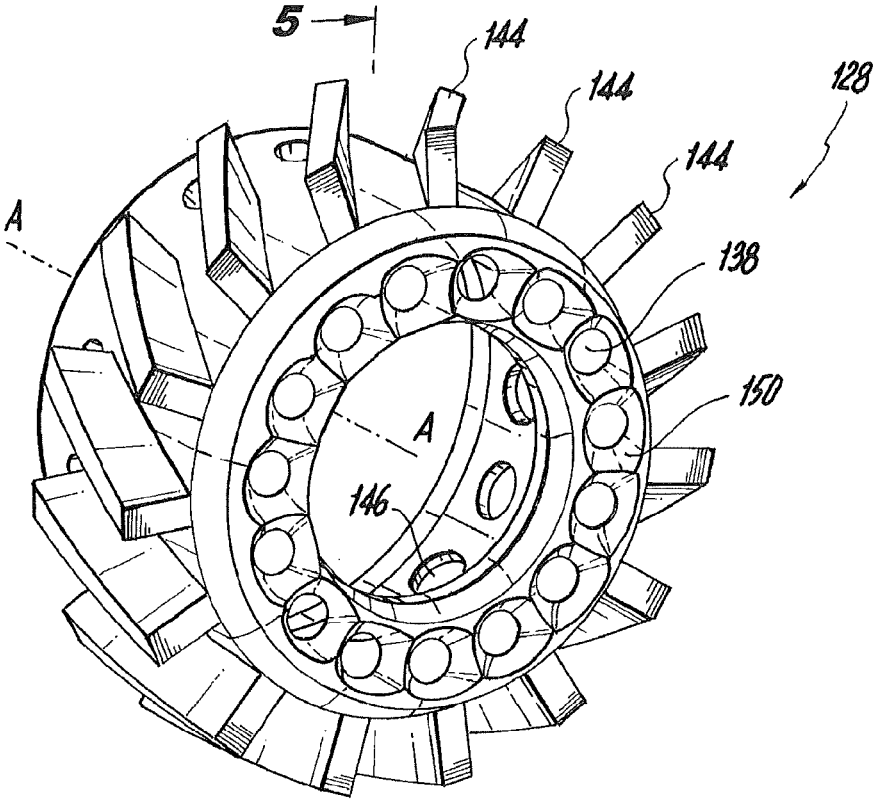
FIG. 4 is a perspective view of a portion of the injector of FIG. 3, showing the downstream surfaces of the air body ring.
Figure 5:
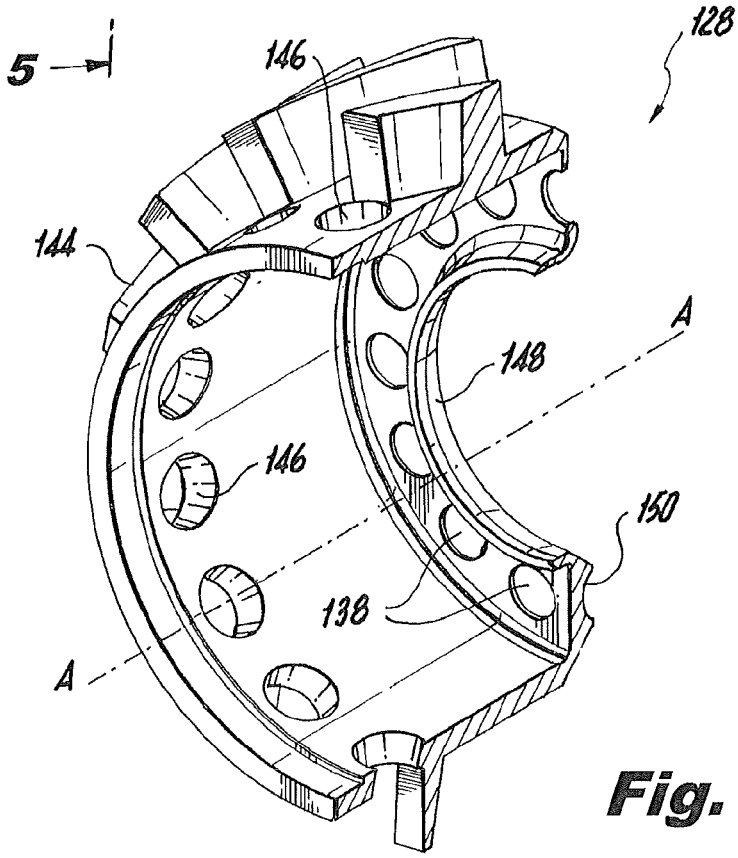
FIG. 5 is a cross-sectional perspective view of the air body ring of FIG. 4, showing the upstream surfaces thereof.

With reference now to FIGS. 4-5, air body 128 directs air for outer air swirler 116 of injector body 108, and provides a portion of the air used in the air swirlers of distributor ring 136. Air for outer air swirler 116 passes through swirl vanes 144, which together with air cap 140 (shown in FIG. 3) form an axial outer air swirler 116 of nozzle body 108. A portion of the air for the swirler of distributor ring 136 is diverted prior to encountering swirl vanes 144 by passing through radial ports 146, and on to a plurality of air outlets 138. Outlets 138 are circumferentially spaced apart with respect to central axis A, with each air outlet 138 being aligned with a respective spray point of distributor ring 136 when air body 128 and distributor ring 136 are mounted together as shown in FIG. 2. While the total number of air outlets 138 is fifteen, for sake of clarity only some of the air outlets 138 are labeled in FIGS. 4-5. Another portion of the air for the fuel swirlers of distributor ring 136 is diverted from the inner air swirler 120 of nozzle body 108, shown in FIG. 2, by inner lip 148, identified in FIG. 5. As shown in FIG. 4, each air outlet 138 of air body ring 128 includes an aerodynamically angled downstream surface 150 configured to be aerodynamically wiped to resist carbon formation thereon. Even if fuel flow for a given injection point is staged off, the aerodynamic wiping of the respective surface 150 can continue as air continues to flow through the injection point. This continued air flow can additionally draw out small, purging flows of fuel from the respective injection point, reducing coking within the inactive fuel stage. Only one of the angled downstream surfaces 150 is identified in FIG. 4, for sake of clarity.

Figure 6A:
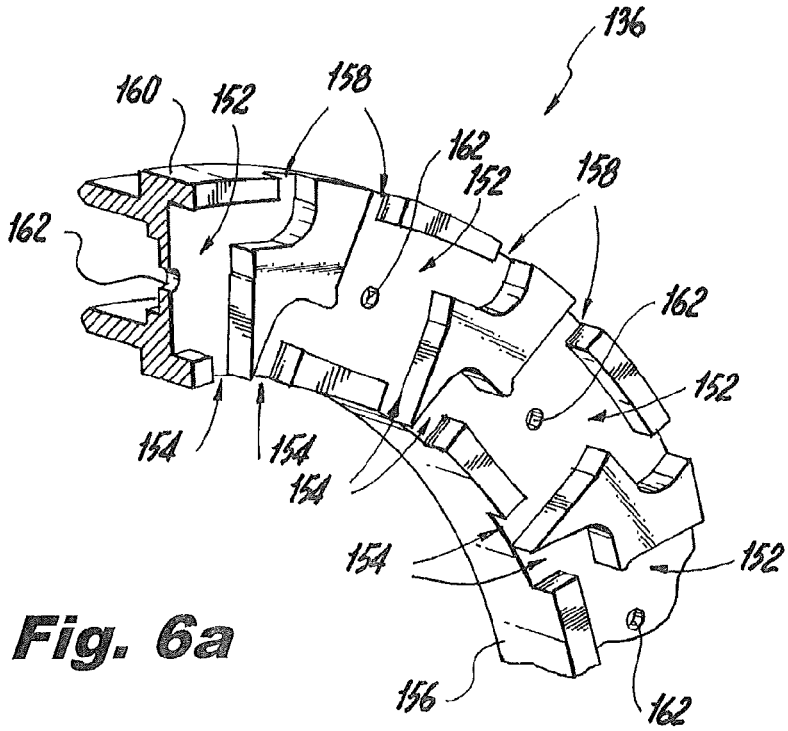
FIG. 6*a* is a cross-sectional perspective view of a portion of the injector of FIG. 3, showing the air swirlers in the downstream face of the distributor ring.
Figure 6B:
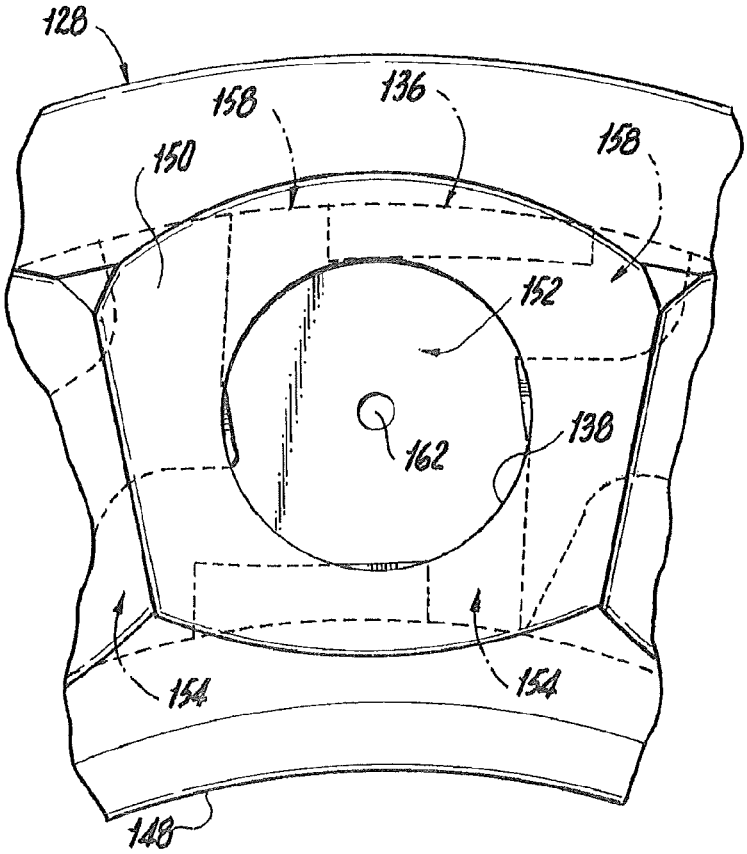
FIG. 6*b* is a downstream end elevation view of a portion of the injector of FIG. 3, showing the air swirler passages formed between the distributor ring and the air body ring.

Referring now to FIGS. 6*a* and 6*b*, distributor ring 136 has swirlers defined in its upstream and its downstream facing surfaces. As shown in FIG. 6*a*, air swirlers 152 are defined in a downstream face of distributor ring 136. Each air swirler 152 includes two inboard air inlets 154 in fluid communication therewith defined in a radially inboard surface 156 of distributor ring 136. Each air swirler 152 also includes two outboard air inlets 158 in fluid communication therewith defined in a radially outboard surface 160 of distributor ring 136. Each of the air inlets 154 and 158 of air swirlers 152 is radially off set with respect to the respective spray orifice 162 thereof to form a radial air swirler about the respective spray orifice 162. The volumes of air swirlers 152 are defined between distributor ring 136 and air body ring 128. FIG. 6*b* schematically shows how inlets 154 and 158 are covered by air body 128, so that in order for air to pass through each outlet 138, it must pass through the tangentially offset inlets 154 and 158 thereby imparting swirl onto the air flow through each outlet 138. Each air swirler 152 is aligned with a respective air outlet 138, and each air outlet 138 is aligned downstream of a respective spray orifice 162 for injecting a swirling flow of fuel and air for air-assisted injection of fuel.

In the upstream portion of distributor ring 136, a plurality of fuel swirlers 164 are defined, as shown in FIGS. 7 and 8. As shown in FIG. 7, there are a total of fifteen fuel swirlers 164 in distributor ring 136, one corresponding to each spray orifice 162. The spray orifices 162 are each defined through distributor ring 136 from the respective fuel swirler 164 to the respective air swirler 152 (shown in FIG. 6*a*). FIG. 8 shows that each fuel swirler 164 includes a central swirl chamber 166, and two inlet chambers 168. Each inlet chamber 168 is fluidly connected to its respective central swirl chamber 166 by an offset fuel passage 170 configured to impart clockwise rotation on fuel in the respective central swirl chamber 166, as viewed in FIG. 8. Those skilled in the art will readily appreciate that any suitable number of fuel and air swirlers can be circumferentially spaced around the axis of distributor ring 136, and that the swirl chambers can be configured for counter clockwise swirl, or can be set up with any configuration of counter- or co-rotational patterns among the swirlers without departing from the spirit and scope of the invention. Fuel swirlers 164 and air swirlers 152 impart swirl onto fuel and air issuing from each injection point through the respective spray orifice 162 of distributor ring 136 and air outlet 138 of air body 128.

Figure 9:
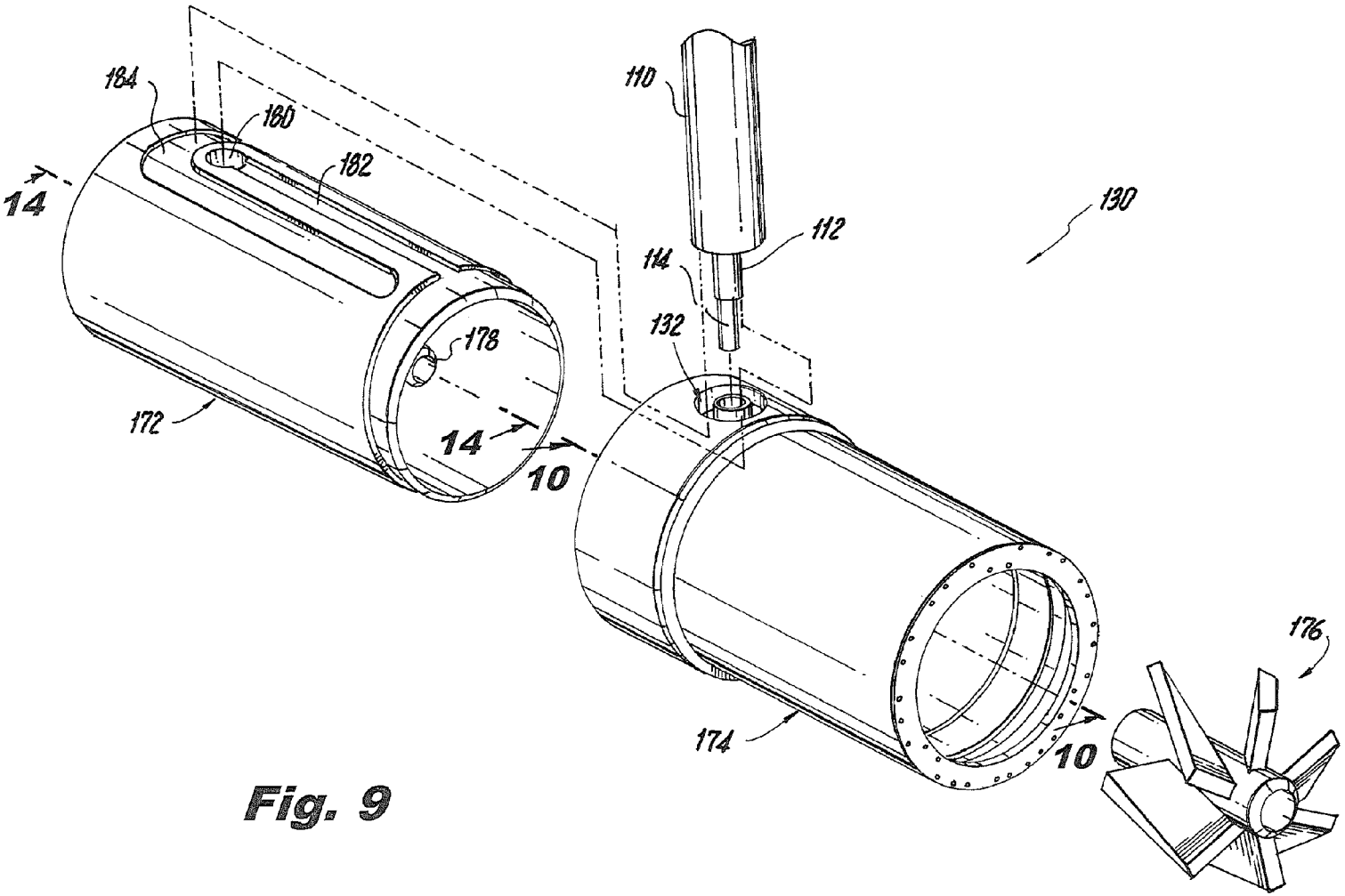
FIG. 9 is a perspective view of a portion of the injector of FIG. 3, showing the inner and outer fuel sleeves.
Figure 10:
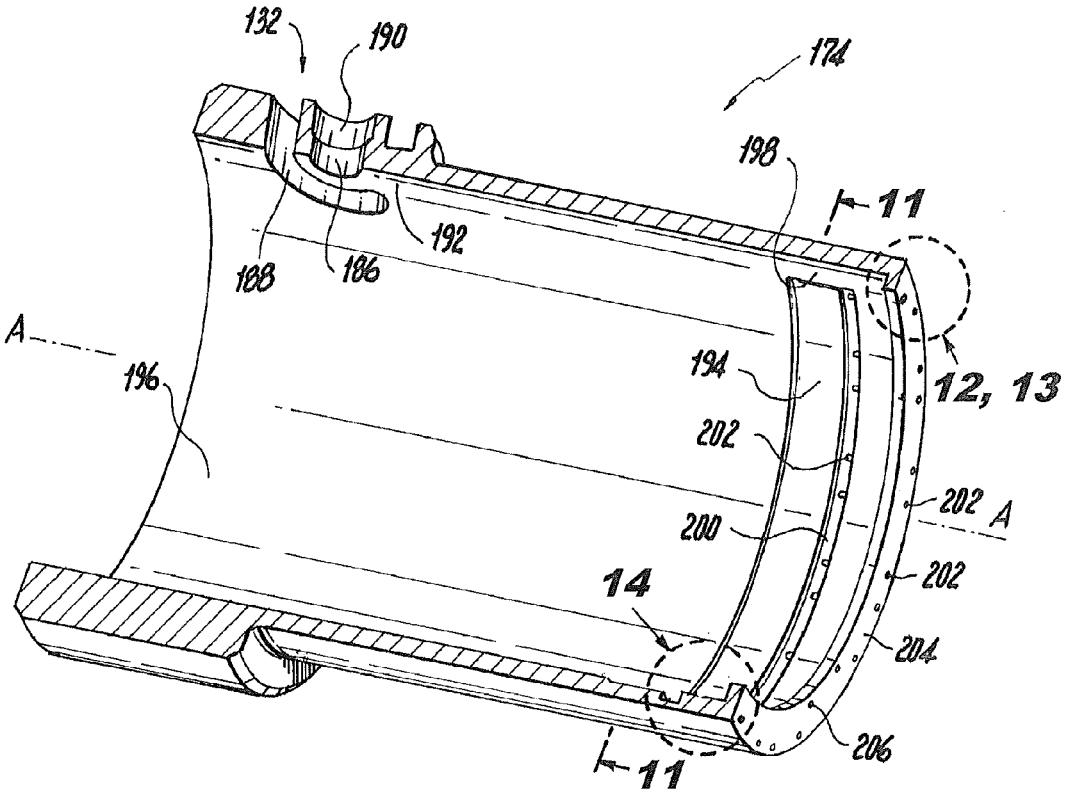
FIG. 10 is a cross-sectional perspective view of the outer fuel sleeve of FIG. 9, showing the fuel passages defined in the interior surface thereof.

Referring now to FIG. 9, the components of injector body 130 are shown separated from one another. Injector body 130 includes an inner fuel sleeve 172, which when assembled is mounted inboard of outer fuel sleeve 174 to form injector body 130. The assembly of inner and outer fuel sleeves 172 and 174 can be done by any suitable process, including the process combining thermal resizing and brazing describe in commonly owned U.S. Patent Application Publication No. 2009/0140073, for example. Fuel inlet 132 of injector body 130 is formed in outer fuel sleeve 174 to accommodate separate fuel flows from concentric conduits 110, 112, and 114. Inner air swirler body 176, having axial swirl vanes, is mounted on central post 178 of inner fuel sleeve 172. There is a fuel bore 180 as well as two fuel passage channels 182 and 184 defined in the outboard surface of inner fuel sleeve 172, each of which corresponds to one of the conduits 110, 112, and 114 for feeding a respective stage of fuel injection points as described in greater detail below.

With reference now to FIGS. 10-14, interior features of outer fuel sleeve 174 are shown. Fuel inlet 132 includes an inner bore 186 through which conduit 114 passes to feed fuel to a first stage fuel injector. There is a clearance between bore 186 and conduit 114, when assembled, that allows passage of fuel from conduit 112 (shown in FIG. 9) into channel 182 (also shown in FIG. 9) to a second stage of fuel injector points. Conduit 112 mates with the large diameter portion 190 of bore 186. Fuel inlet 132 also includes an outer passage 188 for conducting fuel from conduit 110 into channel 184 (shown in FIG. 9) for supplying a third stage of injector points. A cantilever 192 is provided to connect the structure of inner bore 186 to the main portion of outer fuel sleeve 174.

Figure 11:
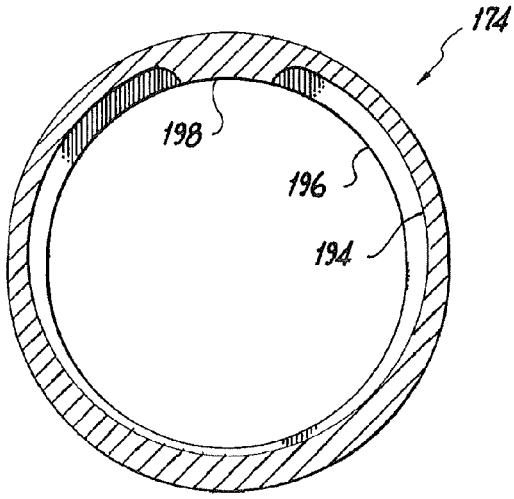
FIG. 11 is cross-sectional end view of the portion of the outer fuel sleeve indicated in FIG. 10, showing the eccentricity of the main circumferential channel in the interior surface of the outer fuel sleeve.
Figure 13:
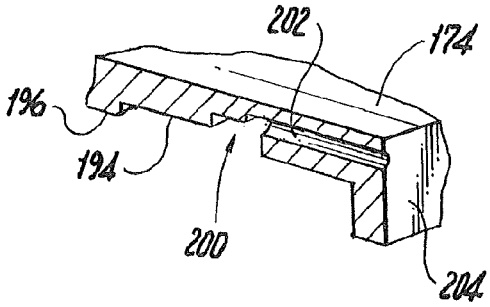
FIG. 13 is a cross-sectional perspective view of the portion of the outer fuel sleeve indicated in FIG. 10, showing one of the fuel outlet orifices of the third stage fuel circuit.
Figure 12:
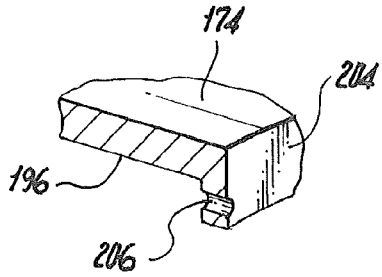
FIG. 12 is a cross-sectional perspective view of the portion of the outer fuel sleeve indicated in FIG. 10, showing one of the fuel outlet orifices of the second stage fuel circuit.
Figure 14:
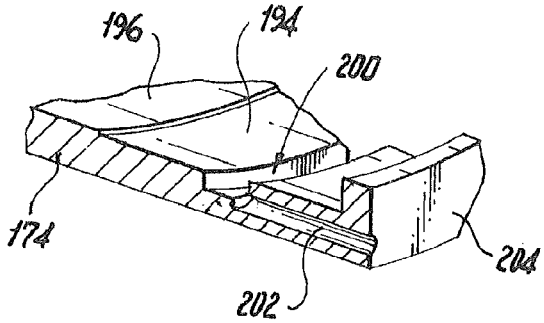
FIG. 14 is a cross-sectional perspective view of the portion of the outer fuel sleeve indicated in FIG. 10, showing the circumferential fuel channels in the inner surface of the outer fuel sleeve.

Portions of the third stage fuel circuit are defined in the inboard surface of outer fuel sleeve 174. Channel 194 forms a portion of the third stage fuel circuit. Channel 194 is a generally annular channel set in from the main inner surface 196 of outer fuel sleeve 174. Channel 194 runs in a circumferential direction with respect to axis-A, but is interrupted at its top most portion, as oriented in FIG. 10, by a land 198 that is flush with the rest of the main inner surface 196. FIG. 11 shows a channel 194 and land 198 in cross-section. The thicknesses of outer fuel sleeve 174 and channel 194 are somewhat exaggerated in FIG. 11 for sake of clarity. Channel 194 is not concentric with the adjacent inner and outer diameters of inner fuel sleeve 174. Rather, channel 194 is eccentric with respect to main inner surface 196. As shown in FIGS. 11 and 13, channel 194 is relatively deep at a position near land 198, i.e., near the top of outer fuel sleeve 174 as oriented in FIG. 10. As shown in FIGS. 11 and 14, channel 194 is relatively shallow at a position near the bottom of outer fuel sleeve 174 as oriented in FIG. 10. The eccentricity of channel 194 accounts for pressure drop to allow for even flow to all of the injection points of the third fuel stage. Channel 194 is a main circumferential channel that is in fluid communication with adjacent circumferential channel 200, which has a constant depth around its circumference, interrupted only by land 198. Third stage fuel bores 202 extend from downstream surface 204 of outer fuel sleeve 174. For sake of clarity, only some of the fuel bores 202 are identified with reference characters in FIG. 10, however, FIGS. 13 and 14 each show a cross-section of a respective one of the fuel bores 202. Fuel bores 202 can be formed, for example, by drilling in an axial direction from downstream surface 204 into channel 200. FIG. 12 shows one of the fuel bores 206 of the second fuel stage, which is described in greater detail below. There are a total of six fuel bores 206, however, only one fuel bore 206 is identified with a reference character in FIG. 10 for sake of clarity.

Figure 15:
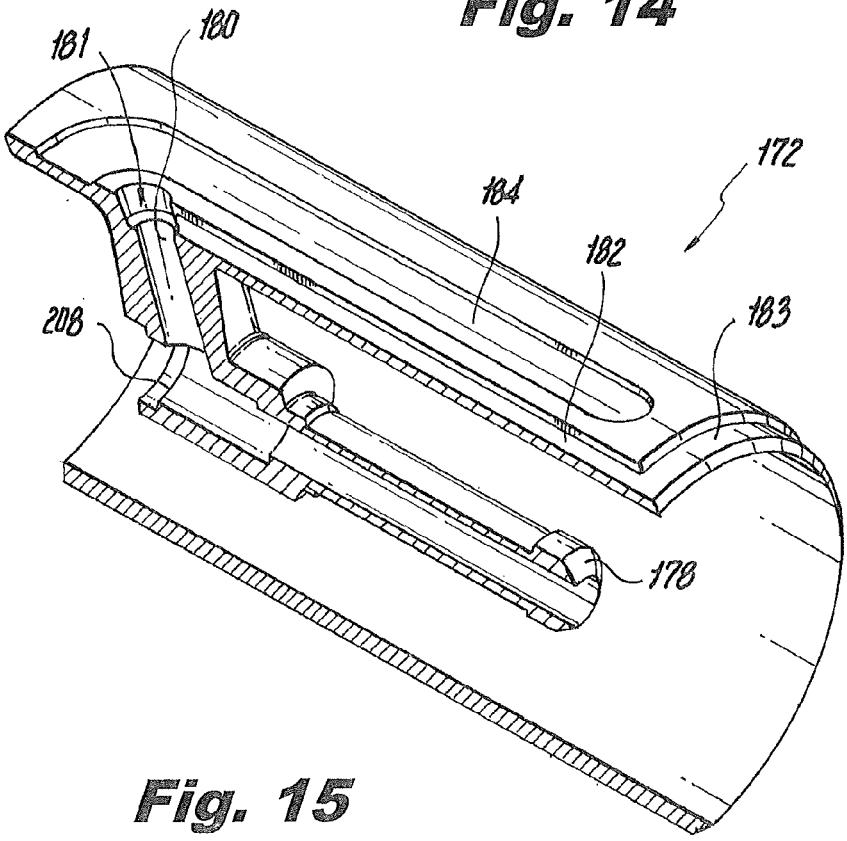
FIG. 15 is a cross-sectional perspective view of the inner fuel sleeve of FIG. 9, showing the fuel passages in the outer surface thereof.

With reference now to FIG. 15, inner fuel sleeve 172 includes portions of the first, second, and third stage fuel circuits. Fuel bore 180 mates with conduit 114 (shown in FIG. 20) to allow passage of fuel into central post 178, which when fully assembled leads to a centerline injection point of the first fuel stage. Channel 182 is defined in the outboard surface of inner fuel sleeve 172 and extends from fuel bore 180 in an axial direction to circumferential channel 183 to form a portion of the second stage fuel circuit. Enlarged portion 181 of bore 180 allows for a clearance between conduit 114 and bore 180 at the upstream end of channel 182 to allow fuel from conduit 112 to pass into the second stage fuel circuit. A u-shaped channel 184, defined in the radially outer surface of inner fuel sleeve 172 and extending in a generally axial direction, fluidly connects outer passage 188 (shown in FIG. 10) and conduit 110 to the third stage fuel circuit. An upstream opening 208 in central post 178 allows for assembly of fuel injector components inside central post 178.

Figure 16:
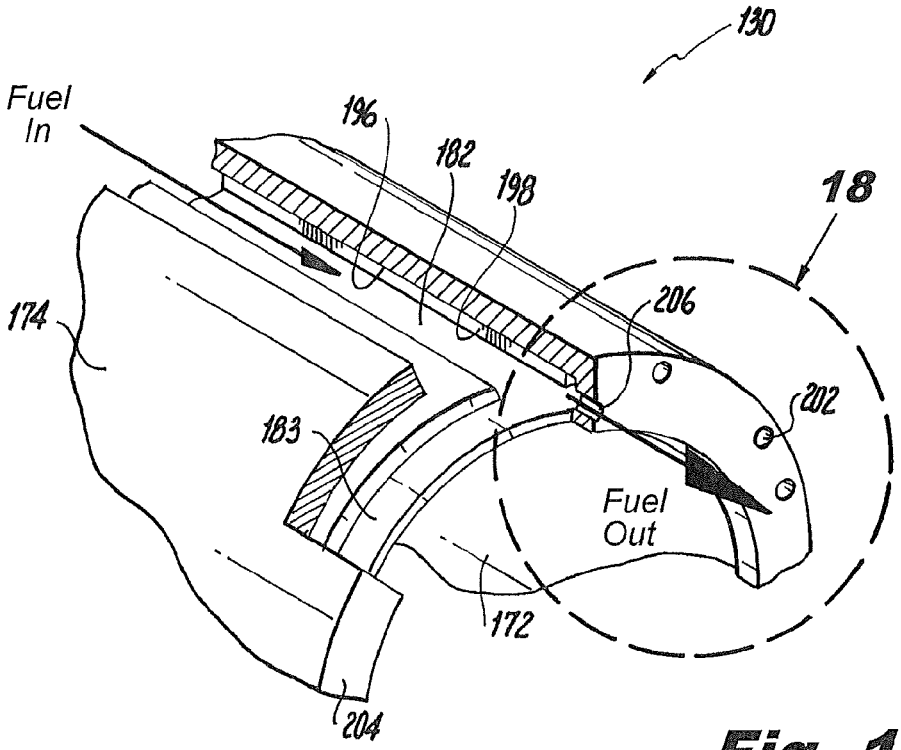
FIG. 16 is a partial cross-sectional perspective view of a portion of the inner and outer fuel sleeves of FIG. 9, showing the fuel circuit of the second fuel stage.
Figure 17:
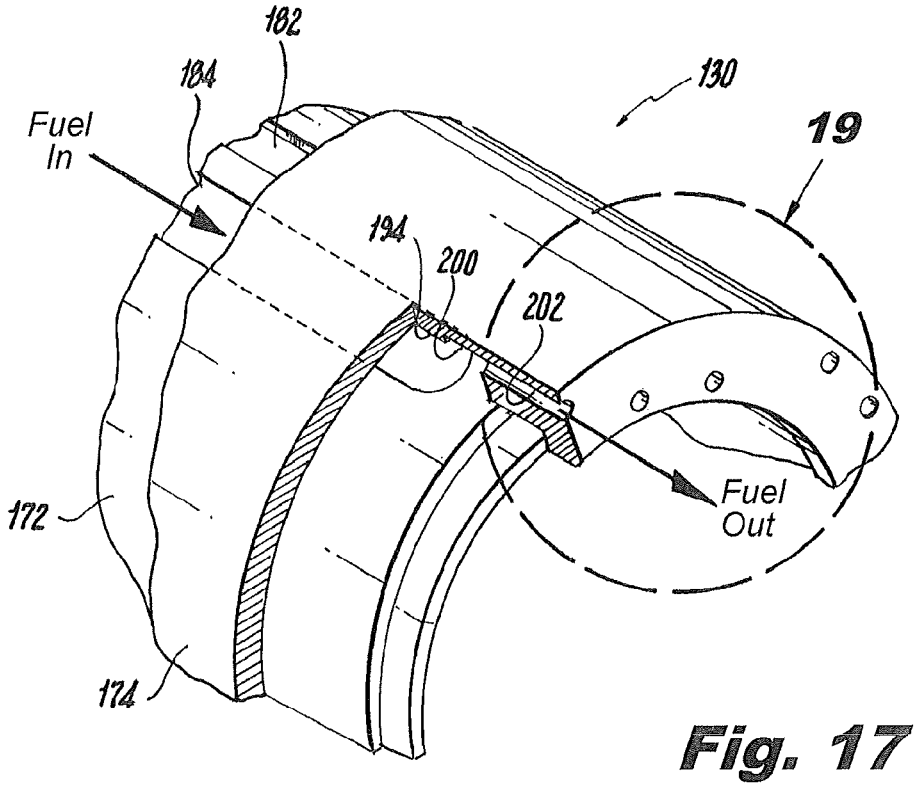
FIG. 17 is a partial cross-sectional perspective view of a portion of the inner and outer fuel sleeves of FIG. 9, showing the fuel circuit of the third fuel stage.
Figure 23:
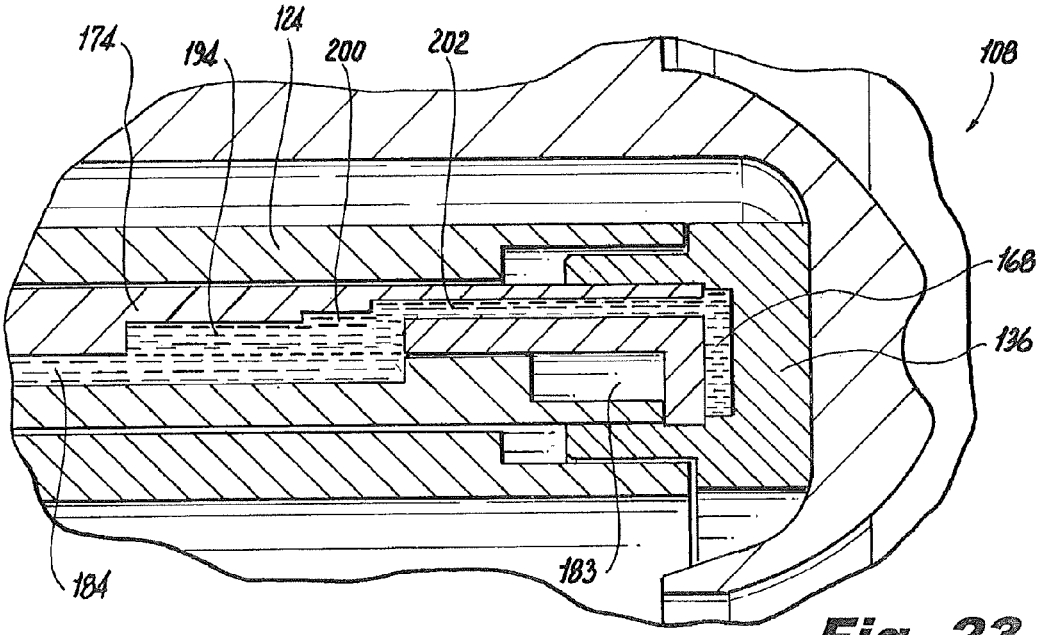
FIG. 23 is a radial cross-sectional elevation view of the injector of FIG. 22, showing fuel within the third stage fuel circuit.
Figure 25:
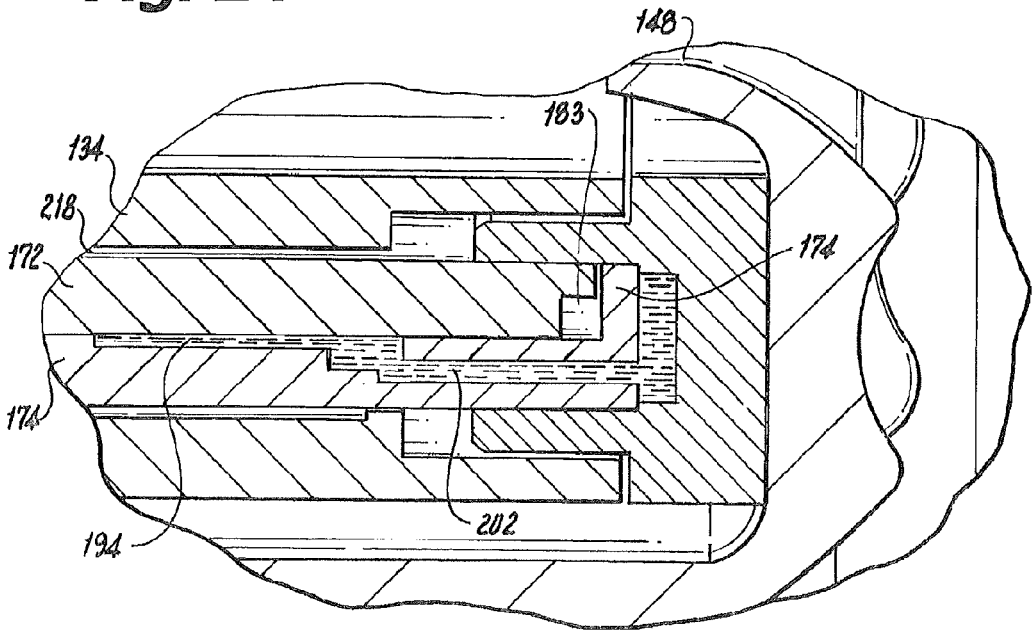
FIG. 25 is a radial cross-sectional elevation view of a portion of the injector of FIG. 24, showing fuel within the third stage fuel circuit.

Referring now to FIGS. 16 and 17, arrows indicate downstream portions of the fuel circuits of the second and third stages in injector body 130, respectively. Second stage fuel from conduit 112 (shown in FIG. 9) passes through bore 186 (shown in FIG. 10) and into fuel bore 180 and channel 182. Main inner surface 196 of outer fuel sleeve 174 encloses channel 182, and land 198 prevents second stage fuel in channel 182 from reaching channel 184 or channel 194 of outer fuel sleeve 174. At its downstream end, channel 182 joins circumferential channel 183. Fuel in channel 183 can feed out through fuel bores 206, as indicated by the arrow labeled "fuel out" in FIG. 16. Fuel channel 183 narrows in the axial direction (i.e., it is wider near the top of FIG. 15, and narrower at the bottom) in order to provide even flow to all of the second stage injection points. This can be seen by comparing the axial width of channel 183 as shown in FIGS. 23 and 25.

With respect to the third fuel stage, conduit 110 feeds second stage fuel through outer passage 188 (shown in FIG. 10) into channel 184 as shown in FIG. 17. Main inner surface 196 of outer fuel sleeve 174 encloses channel 184 except at the downstream ends thereof, which are in fluid communication with channel 194. As indicated by the arrow labeled "fuel in" and the arrow labeled "fuel out" in FIG. 17, third stage fuel from channel 184 feeds channel 200 and fuel bores 202 of the third fuel stage.

Figure 18:
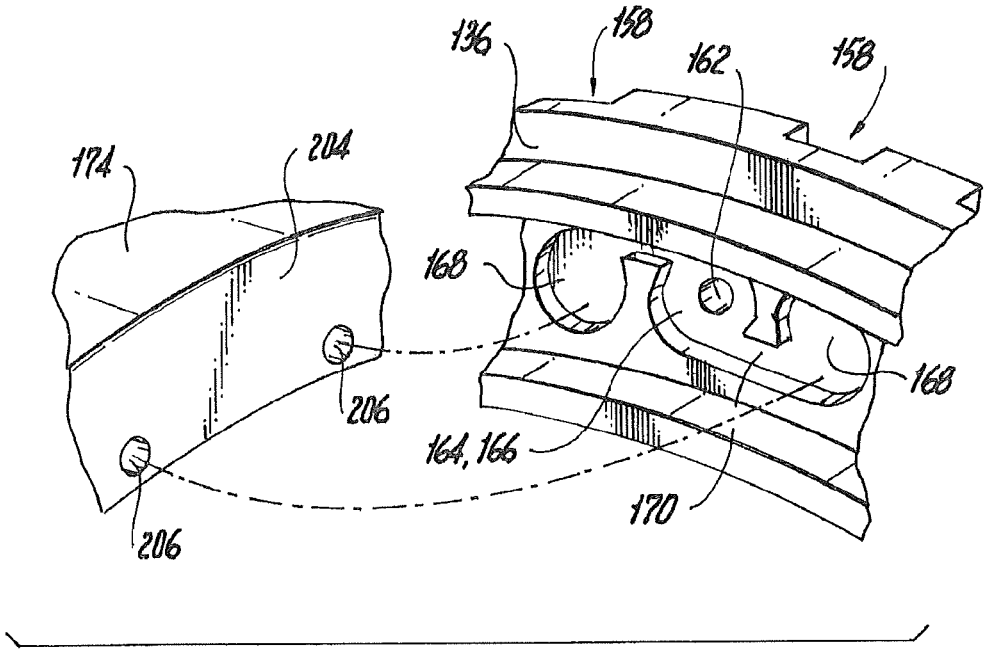
FIG. 18 is an exploded perspective view of a portion of the outer fuel sleeve and distributor ring of FIG. 3, schematically showing the routing of fuel of the second stage fuel circuit from the outer fuel sleeve to the distributor ring.
Figure 19:
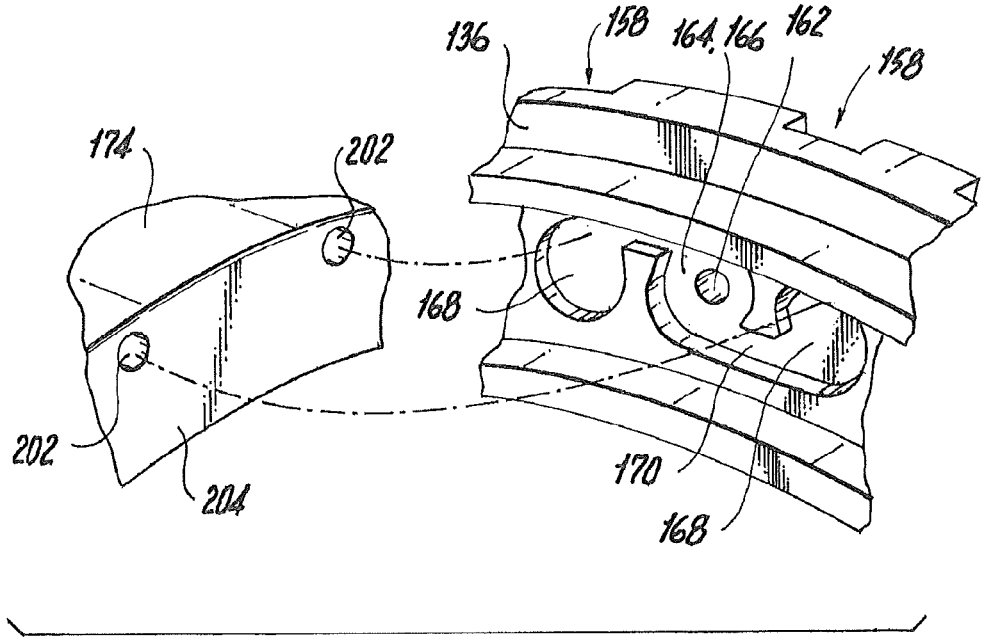
FIG. 19 is an exploded perspective view of a portion of the outer fuel sleeve and distributor ring of FIG. 3, schematically showing the routing of fuel of the third fuel circuit from the outer fuel sleeve to the distributor ring.

With reference now to FIGS. 18 and 19, fuel bores 202 and 206 of outer fuel sleeve 174 are in fluid communication with the fuel swirlers 164 of distributor ring 136. Two of the fuel bores 206 of the second stage fuel circuit are shown in FIG. 18, which shows schematically where the fuel bores 206 feed into inlet chambers 168 of a fuel swirler 164. Similarly, FIG. 19 shows schematically where two of the fuel bores 202 of the third stage fuel circuit feed into inlet chambers 168 of another fuel swirler 164. Each fuel swirler 164 is in fluid communication with two fuel bores 202 or 206 of outer fuel sleeve 174. This allows fuel to be supplied through both offset fuel passages 170 into the central swirl chamber 166 and out the spray orifice 162 of each fuel swirler 164. Since there are twelve spray orifices 162 in the third fuel stage, and three spray orifices 162 in the second fuel stage, there are twelve pairs of fuel bores 202 and three pairs of fuel bores 206 in outer fuel sleeve 174. Comparing fuel bores 206 in FIG. 18 with fuel bores 202 in FIG. 19, it can be seen that fuel bores 202 lie on a circumference that is radially outboard of the circumference on which fuel bores 206 lie. While only one spray orifice 162 is identified with a reference character in FIG. 2, as viewed in FIG. 2, the three second stage spray orifices 162 are at the twelve o'clock, four o'clock, and eight o'clock positions. The remaining twelve spray orifices 162 are part of the third fuel stage.

The swirler configuration of swirlers 164 is exemplary, and those skilled in the art will readily appreciate that any suitable swirler configurations can be used without departing from the spirit and scope of the invention. For example, the swirler configurations shown in commonly owned, copending U.S. patent application Ser. No. 12/535,122 (Publication No. 2011/0031333) can be used as appropriate from application to application.

Figure 20:
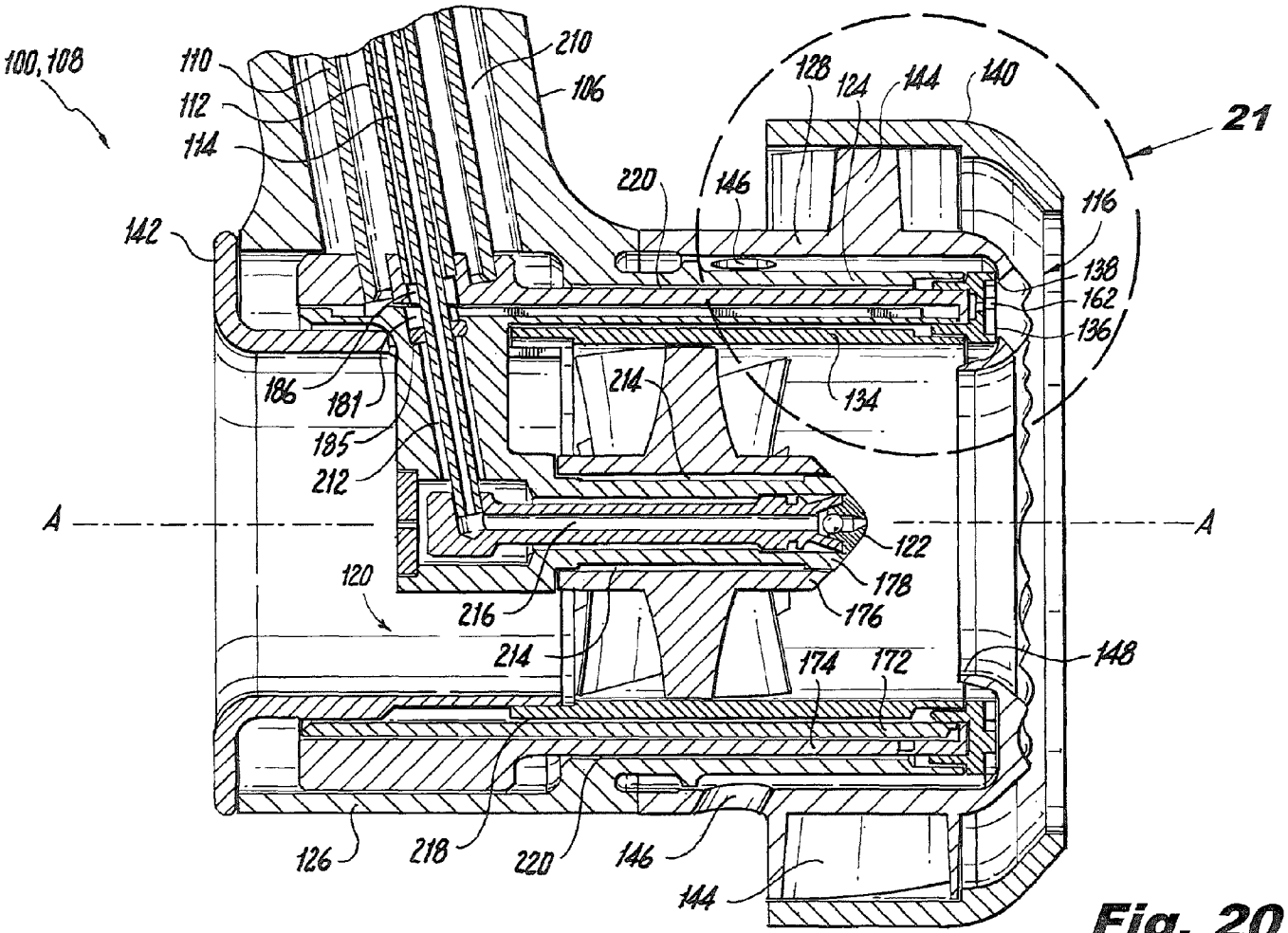
FIG. 20 is a cross-sectional elevation view of a portion of the injector of FIG. 1, showing the inner air circuit and first stage fuel circuit along the central axis of the multipoint injector ring.

With reference now to FIG. 20, the fuel and air circuits of the nozzle body 108 of injector 100 are described. The first fuel stage includes conduit 114 and inner fuel injector 122, which is a pressure atomizer. The second fuel stage includes the space between conduits 112 and 114, includes enlarged bore portion 181 and bore 186, channels 182 and 183, and the spray orifices 162 associated with the second stage fuel bores 206 as described above with reference to FIG. 16. The third fuel stage includes the space between conduits 110 and 112, passage 188 (shown in FIG. 10), u-shaped channel 184 of inner fuel sleeve 172 (shown in FIG. 9), channels 194 and 200 of outer fuel sleeve 174 (shown in FIG. 10), and the spray orifices 162 associated with the third stage fuel bores 202 as described above with reference to FIG. 17.

Inner air swirler body 176, upstream inner heat shield 142, and downstream inner heat shield 134 define inner air swirler 120, which provides a swirling flow of air outboard of spray from inner fuel injector 122, and inboard of spray orifices 162. Air cap 140 and air body 128 define outer air swirler 116, which provides a swirling flow of air outboard of spray orifices 162. This configuration gives injector 100 many of the beneficial flame anchoring and stabilization characteristics of an airblast fuel injector wherein there is an inner and outer air swirler, with inner fuel injector inboard of the inner air swirler, and wherein the multiple injection points of spray orifices 162 provide fuel spray between the inner and outer air swirlers. Inner air swirler 120 and outer air swirler 116 form inner and outer air circuits, respectively. These inner and outer air circuits can induce more or less spin into the fuel spray from the multiple injection points, depending on whether the air circuits are co- or counter-rotating. Those skilled in the art will readily appreciate that either co-rotating or counter-rotating configurations can be used from application to application.

With continued reference to FIG. 20, air is provided to each individual air swirler 152 (shown in FIG. 6*a*) of distributor ring 136 for air assisted injection at each corresponding injection point. A first portion of the air for swirlers 152 is supplied from outboard of air body 128 through radial ports 146, through the annular space between air body 128 and outer heat shield 124, and into air swirlers 152 through their respective outboard air inlets 158 (shown in FIG. 6*a*). Each radial port 146 is aligned with the upstream end of a swirl vane 144 to help force air into the radial port 146 (as shown in FIG. 5). A second portion of the air for swirlers 152 is supplied from inboard of air body 128 from inner air swirler 120. Inner lip 148 protrudes into inner air swirler 120 and directs a portion of the air flow therefrom into inboard inlets 154 (shown in FIG. 6*a*) of air swirlers 152.

Heat shielding is provided for the fuel circuits of all three fuel stages as they flow from feed arm 106 to the downstream end of nozzle body 108. In gas turbine engine applications, for example, the air flowing through and around air blast fuel injectors can be in excess of 400° F., which is hot enough to decompose fuel into its constituent parts. If left unchecked, fuel reaching these temperatures can form coke deposits in the fuel passages, which can restrict or even block fuel flow. To reduce or eliminate coking and other thermal management issues, the fuel passages in nozzle body 108 are thermally isolated from external conditions. Feed arm 106 includes an insulation gap 210 for thermally isolating all three of the conduits 110, 112, and 114 passing therethrough from external conditions. The first stage fuel circuit includes an insulation gap 212 between inner fuel sleeve 172 and conduit 114. A seal 185 (shown in FIG. 20) seals between conduit 114 and enlarged portion 181 of bore 180 to separate the second fuel stage from insulating gap 212. An axial insulation gap 214 is provided between inner air swirler body 176 and central post 178 to thermally isolate fuel flowing through centerline fuel passage 216 to inner fuel injector 122 from air flowing through inner air swirler 120. Upstream and downstream inner heat shields 142 and 134 are spaced radially apart from inner fuel sleeve 172 to provide an insulation gap 218 therebetween. Gap 218 provides thermal isolation to second and third stage fuel passing between inner and outer fuel sleeves 172 and 174 from air flowing through inner air swirler 120. Outer heat shield 124 is spaced radially apart from outer fuel sleeve 174 to provide an insulation gap 220 therebetween. Gap 220 provides thermal isolation to the second and third stage fuel passing between inner and outer fuel sleeves 172 and 174 from air flowing through outer air swirler 116, and from air flowing between outer heat shield 124 and air body 128.

Figure 21:
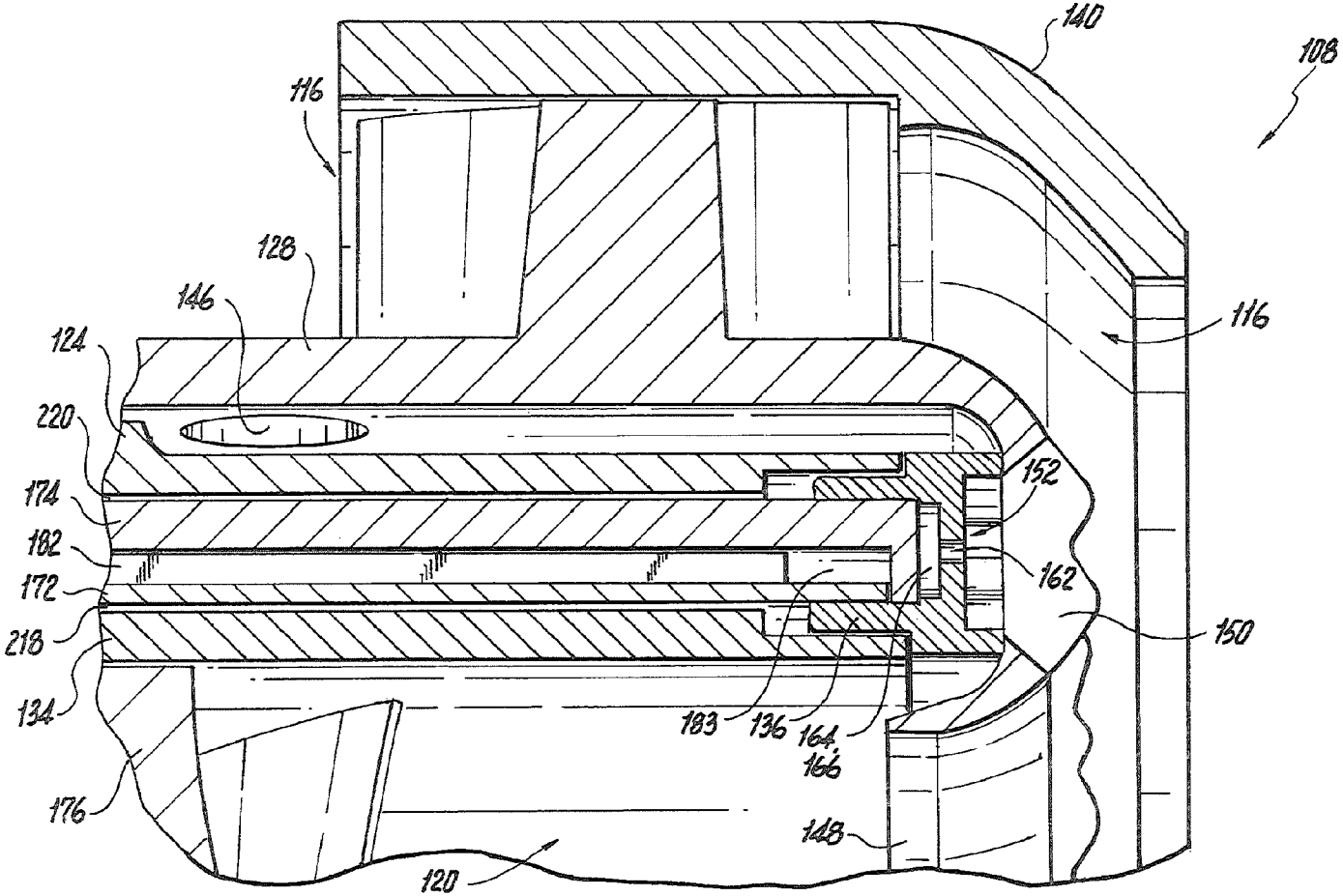
FIG. 21 is a radial cross-sectional view of a portion of the injector of FIG. 1, showing the cross-section of the multipoint injector ring components at one of the fuel orifices of the distributor ring.
Figure 22:
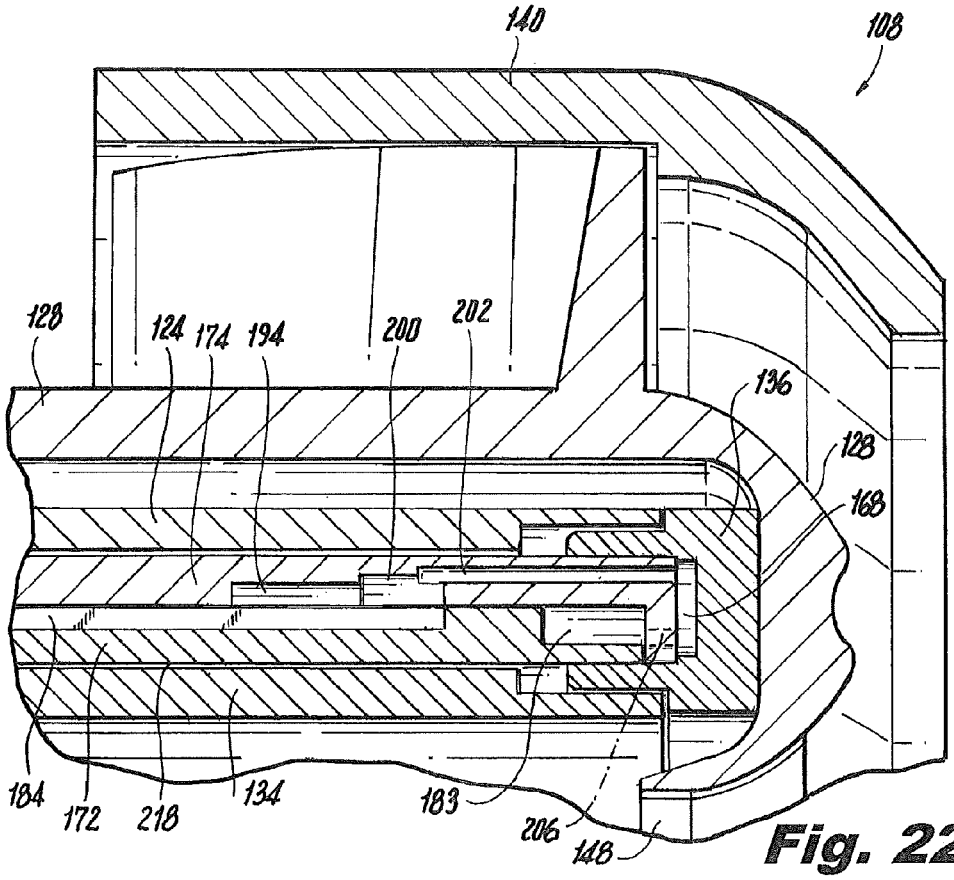
FIG. 22 is a radial cross-sectional view of the portion of the injector indicated in FIG. 2, showing the cross-section of the multipoint injector ring components at one of the third stage fuel bores of the outer fuel sleeve.
Figure 24:
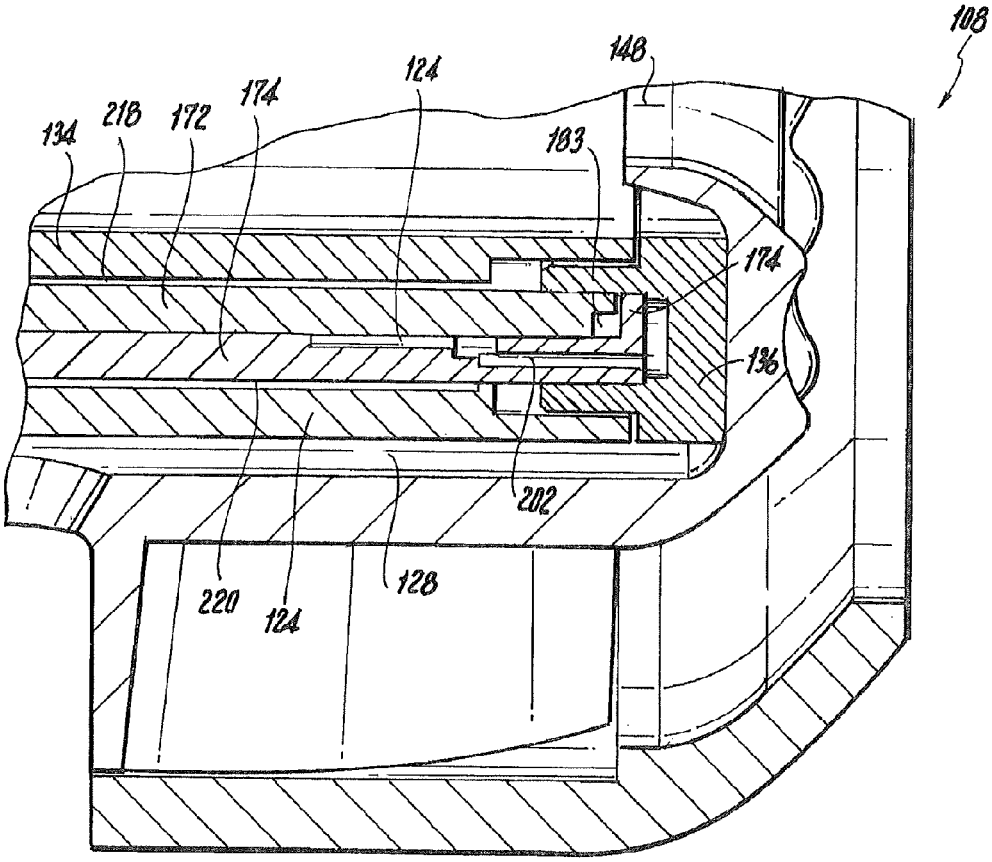
FIG. 24 is a radial cross-sectional view of the portion of the injector indicated in FIG. 2, showing the cross-section of the multipoint injector ring components at one of the third stage fuel outlets of the outer fuel sleeve.

Referring now to FIG. 21, an enlargement of the portion of nozzle body 108 indicated in FIG. 20 is shown. FIG. 21 shows insulating gaps 218 and 220. Channels 182 and 183 between inner and outer fuel sleeves 172 and 174 are shown, as described above. The cross-section of the view in FIG. 21 cuts through spray orifice 162 to show how this fluidly connects central swirl chamber 166 of fuel swirler 164 to air swirler 152 of distributor ring 136. Lip 148 and radial ports 146 of air body 128 for feeding air to air swirler 152 are also shown. FIG. 22 shows a similar cross-section as that shown in FIG. 21, however, the cross-section in FIG. 22 is taken through fuel bore 202 of the third fuel stage. Channels 184 and 194 and fuel bore 202 are shown in fluid communication with each other for supplying fuel to fuel bore 202, which is in fluid communication with inlet chamber 168 of fuel swirler 164. A portion of channel 183 of the second fuel stage is also shown in FIG. 22, in fluid isolation from channel 184. FIG. 23 shows channels 184, 194, and 200 of the third fuel stage filled with fuel being supplied to fuel bore 202 and inlet chamber 168 of fuel swirler 164. Channel 183 of the second fuel stage is shown without fuel therein. FIGS. 24 and 25 correspond to FIGS. 22 and 23, being similar cross-sections through a different fuel bore 202 of the third fuel stage, showing the third stage fuel passages without fuel and with fuel, respectively. Comparing FIG. 22 to FIG. 24, and comparing FIG. 23 with FIG. 25 shows the eccentricity of channel 194 in outer fuel sleeve 174. In FIGS. 22 and 23, channel 194 is relatively deep, and in the opposite side of outer fuel sleeve 174, FIGS. 23 and 25, channel 194 is relatively shallow. This eccentricity of channel 194 compensates for pressure drop in the third fuel circuit to help ensure even flow to all of the fuel bores 202 as described above.

Figure 26:
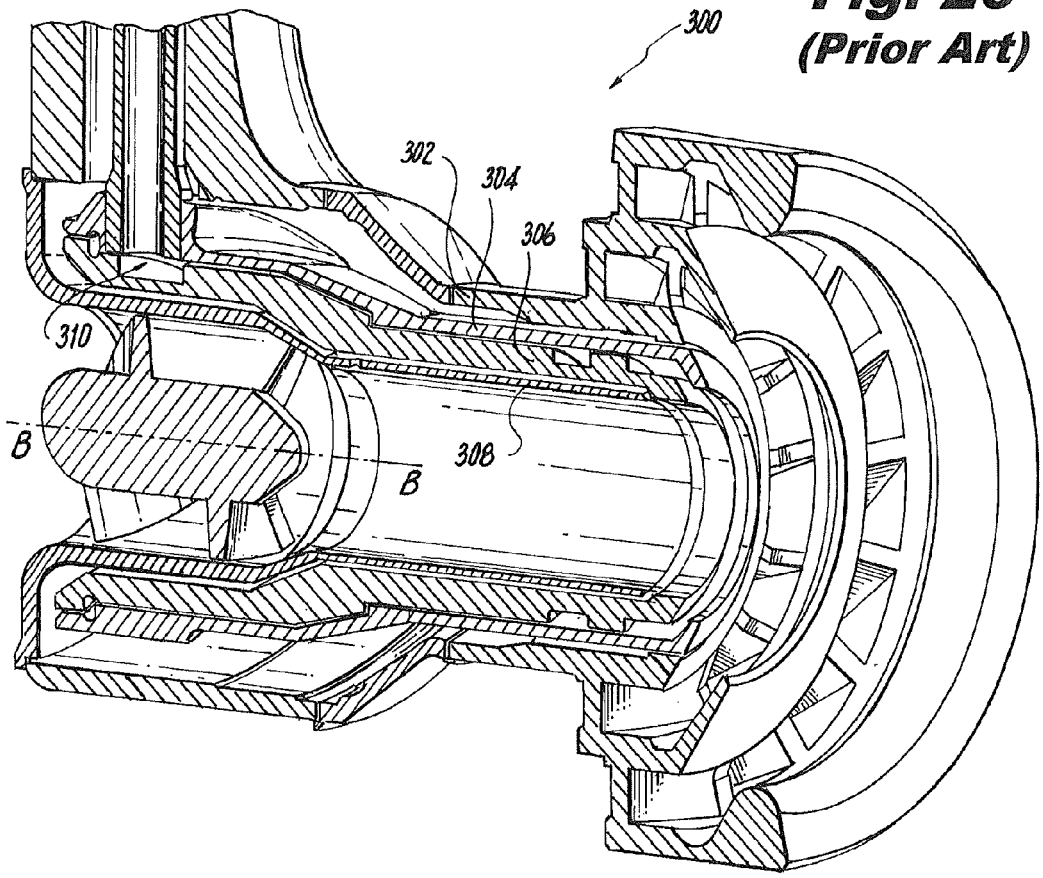
Fig. 26 (Prior Art)
FIG. 26 is a cross-sectional perspective view of a prior art airblast injector, showing the fuel swirler and the inner and outer air swirlers.
Figure 27:
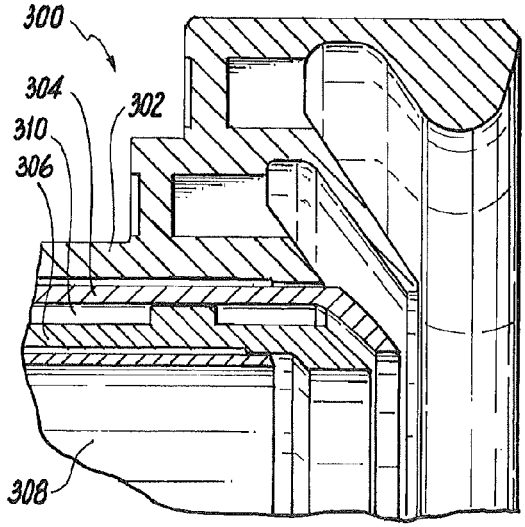
Fig. 27 (Prior Art)
FIG. 27 is a cross-sectional elevation view of a portion of the injector of FIG. 26, showing the outlets of the fuel and air circuits.

The multipoint injectors in accordance with the subject invention can be used in the same or similar form factor envelopes as traditional airblast fuel injectors. Referring now to FIG. 26, an illustration is shown of an exemplary airblast fuel injector 300, for example, a PN 158998 fuel injector available from Goodrich Corporation of Charlotte, N.C. Injector 300 is a prefilming airblast injector and includes an outer air swirler 302, a prefilmer 304, a fuel swirler 306, and an inner air swirler 308, all defining a central axis B. FIG. 27 shows an enlarged view of the downstream ends of air cap 302, a prefilmer 304, a fuel swirler 306, and an inner air swirler 308. A fuel circuit 310 passes between prefilmer 304 and fuel swirler 306.

Figure 28:
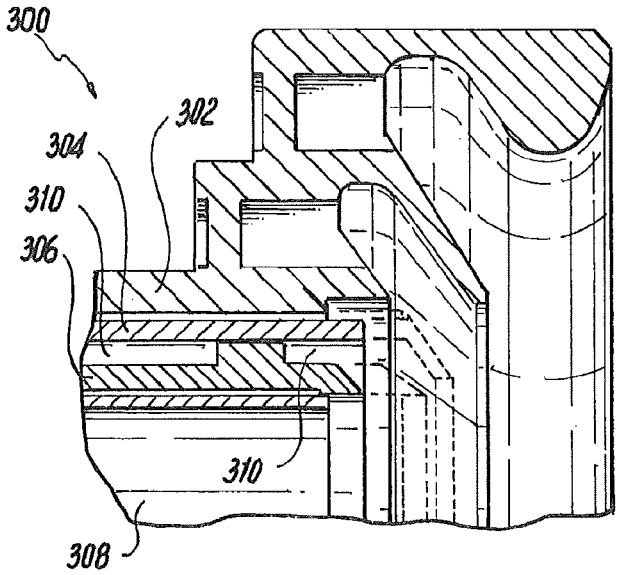
FIG. 28 is a cross-sectional elevation view of an exemplary embodiment of a modified injector constructed in accordance with the invention, showing the injector of FIG. 27 modified with portions of the downstream components modified to receive multipoint injector components.
Figure 29:
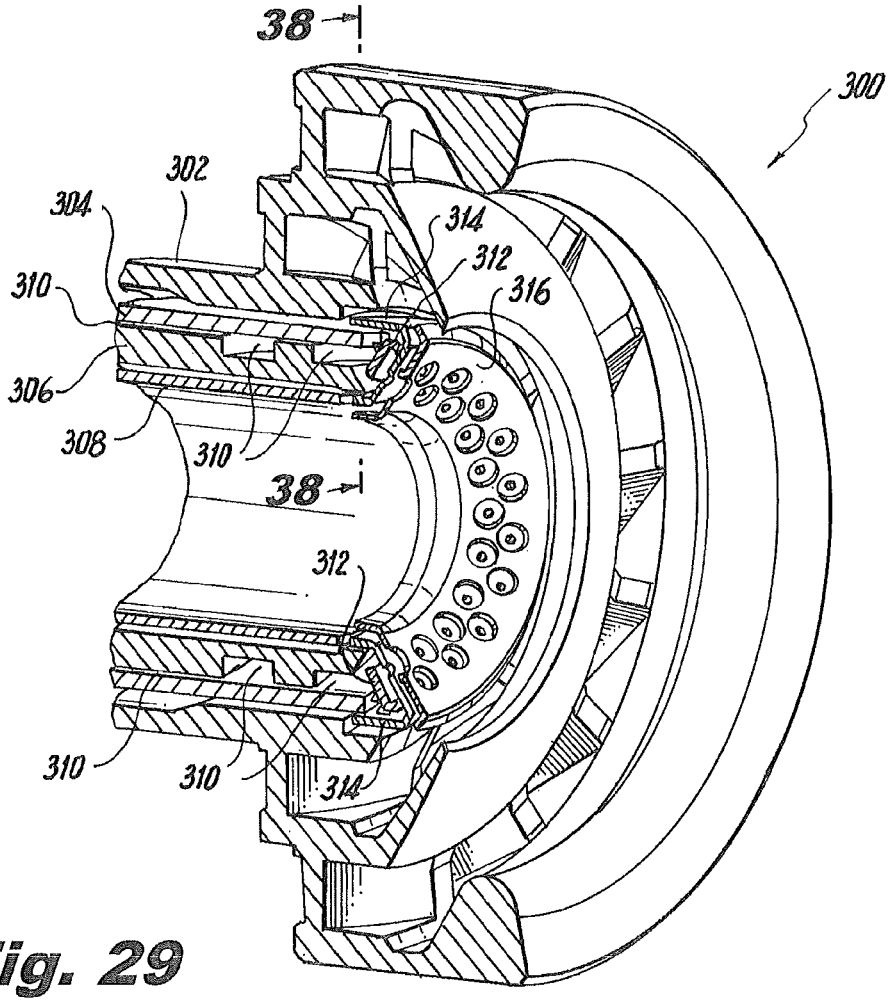
FIG. 29 is a cross-sectional perspective view of the injector of FIG. 28, showing multipoint injector components mounted to the modified downstream components.

Referring now to FIGS. 28-29, injector 300 of FIG. 26 is shown converted to a multipoint configuration. This example is presented in order to exemplify the simplicity and space minimizing features of the present invention. The portions of FIG. 28 shown in phantom lines indicate where components of injector 300 are modified, and FIG. 29 shows multipoint components mounted in injector 300. Three multipoint injector components, namely distributor ring 312, fuel orifice ring 314, and air swirler ring 316 are all that is required in order to convert the fuel dispersion function of prefilmer 304 and fuel swirler 306 to a 40 point air assisted pressure atomizing injector, all the while retaining the flame stabilizing benefit of a strong swirl imparted by outer air swirler 302 and inner air swirler 308. It is contemplated that the exemplary modifications shown in FIGS. 28-29 can be performed as a retrofit on existing traditional injectors, and that the modifications can also be performed at the design level to produce new injectors with the modified design. The modifications provide the benefits of air assisted multipoint lean direct injection for existing gas turbine engines without requiring modification to other existing engine components, since the form factor envelope needed for the modified injectors is not impacted.

Figure 30:
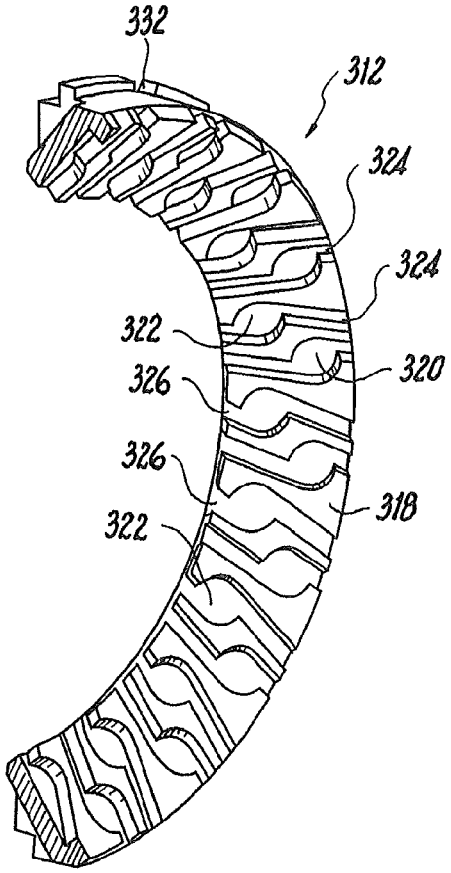
FIG. 30 is a cross-sectional perspective view of a portion of the injector of FIG. 29, showing the fuel swirlers defined in the downstream frustoconical surface of the distributor ring.
Figure 31:
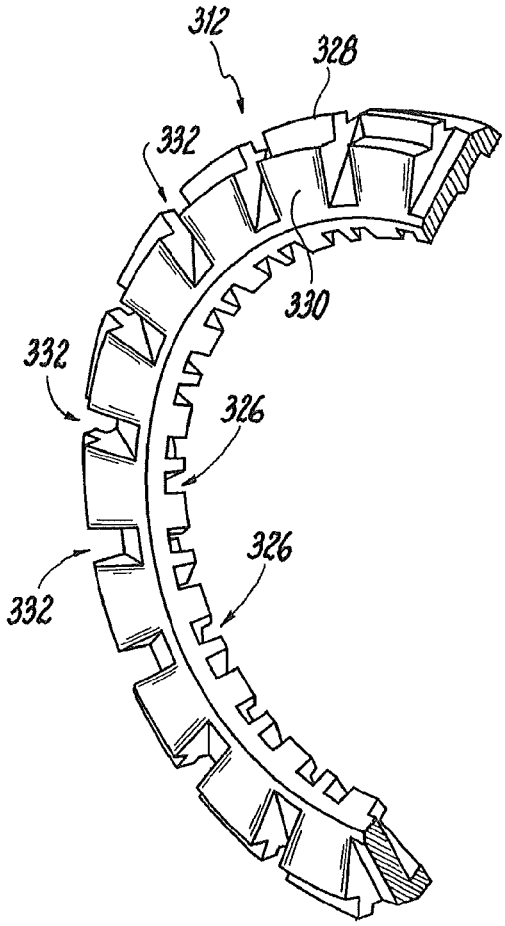
FIG. 31 is a cross-sectional perspective view of a portion of the distributor ring of FIG. 30, showing the upstream features of the distributor ring.

With reference now to FIGS. 30 and 31, distributor ring 312 is shown separately. The downstream surface 318 of distributor ring 312 is a generally diverging, frustoconical surface. As shown in FIG. 30, two arrays of radial fuel swirlers are defined in downstream face 318. The first array of fuel swirlers 320 is radially outboard of the second array of swirlers 322. Each of the fuel swirlers 320 and 322 has a radially offset outboard inlet 324 and a radially offset inboard inlet 326. The radially offset inlets 324 and 326 impart swirl onto fuel flowing into the central chamber of each fuel swirler 320 and 322. For sake of clarity, in FIGS. 31 and 32, not all of the fuel swirlers and inlets are identified with reference characters. Using two closely packed arrays of fuel swirlers allows for more injection points to be included in the limited space of injector 300. The outside diameter of distributor ring 312 is slightly less than about ¾ inch (19 mm) in the example shown, however those skilled in the art will readily appreciate that this dimension is exemplary.

As shown in FIG. 31, the outer circumference 328 and upstream surface 330 of distributor ring 312 are castellated so that fuel can flow from fuel circuit 310 (shown in FIG. 29) through gaps 332 into outboard inlets 324 (shown in FIG. 30) of fuel swirlers 320 and 322. For sake of clarity, not all of the gaps 332 are identified with reference characters in FIG. 31.

Figure 32:
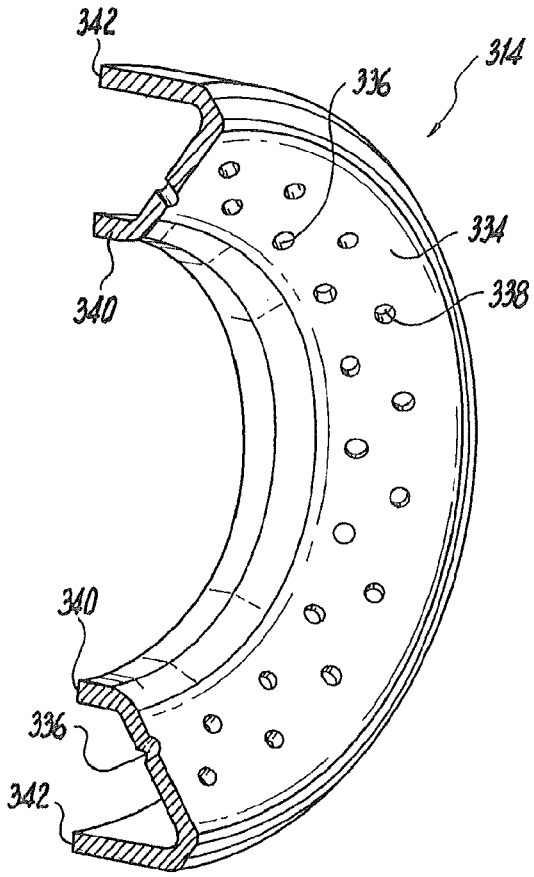
FIG. 32 is a cross-sectional perspective view of a portion of the injector of FIG. 29, showing the downstream frustoconical surface of the fuel orifice ring.
Figure 33:
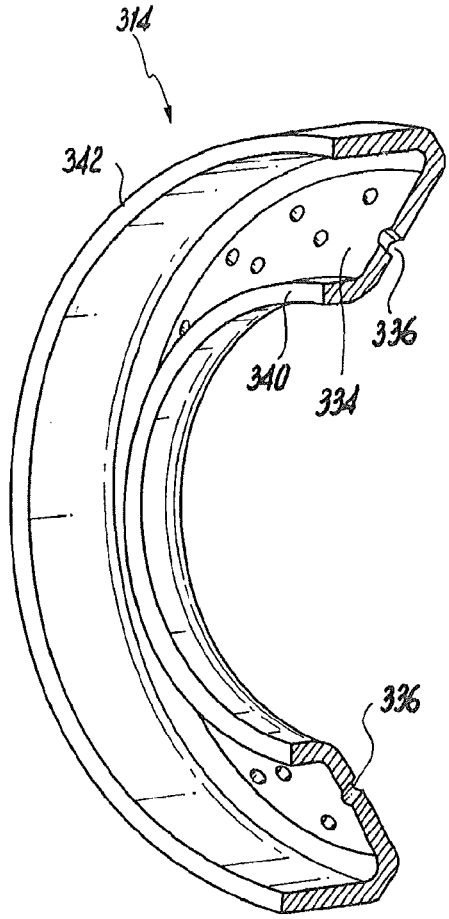
FIG. 33 is a cross-sectional perspective view of the fuel orifice ring of FIG. 32, showing the upstream surfaces of the fuel orifice ring.

Referring now to FIGS. 32 and 33, fuel orifice ring 314 is shown separate from the other components of injector 300 as viewed from downstream and upstream, respectively. Fuel orifice ring 314 includes a main downstream section 334 that is generally frustoconical. An inboard array of fuel outlet orifices 336 and an outboard array of fuel outlet orifices 338 are defined through section 334, for a total of forty outlet orifices. By way of non-limiting example, if each of the forty orifices has a flow number of 1.5, then the multipoint array would have a total flow number of 60. Fuel orifices 336 and 338 are circumferentially spaced apart with respect to the central axis B (identified by reference characters in FIG. 26). An inboard flange 340 and an outboard flange 342 extend axially upstream from section 334 for engagement with the components of injector 300, as shown in FIG. 29.

Figure 34:
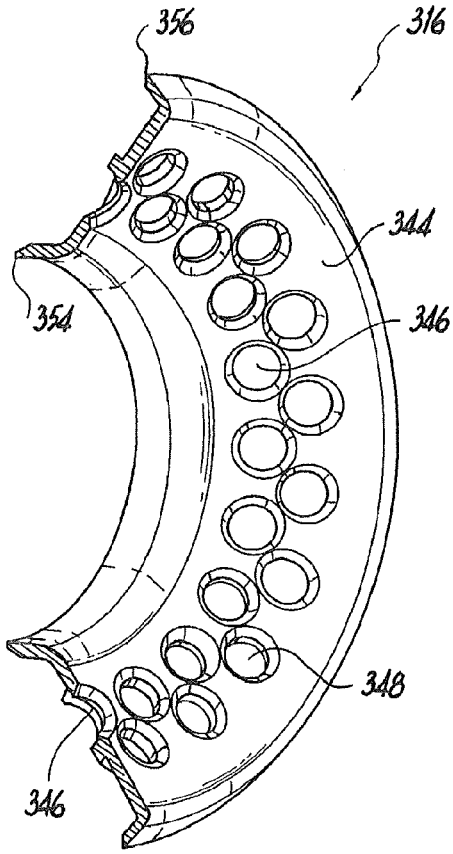
FIG. 34 is a cross-sectional perspective view of a portion of the injector of FIG. 29, showing the downstream features of the air swirler ring.
Figure 35:
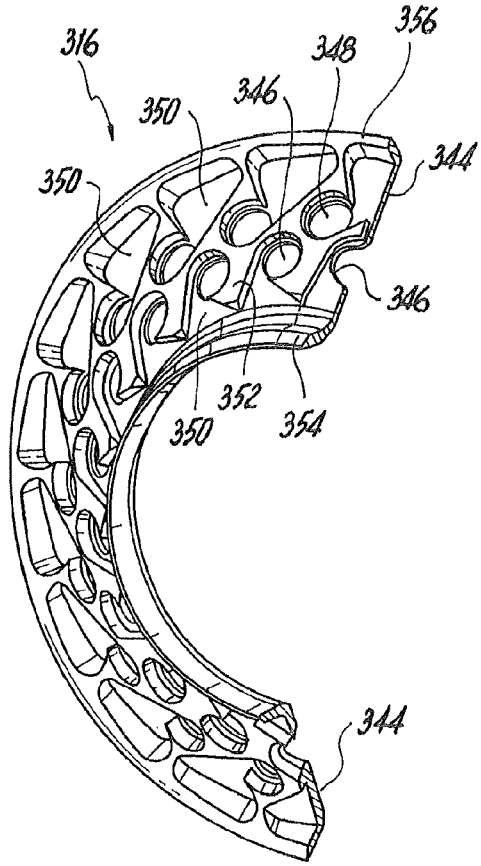
FIG. 35 is a cross-sectional perspective view of the air swirler ring of FIG. 34, showing the air swirlers defined in the upstream surface of the air swirler ring.

With reference now to FIGS. 34 and 35, air swirler ring 316 is shown as viewed from a point downstream and from a point upstream, respectively. Main section 344 of air swirler ring 316 is generally frustoconical and includes inboard and outboard arrays of outlet orifices 346 and 348, respectively, corresponding to fuel swirlers 322 and 320 and fuel orifices 336 and 338 described above. Orifices 346 and 348 are outlets for air and fuel issuing from injector 300, as described below in greater detail. For sake of clarity, not all of the outlet orifices 346 and 348 are identified with reference characters in FIGS. 34 and 35. As shown in FIG. 35, each outlet orifice 346 and 348 has an air swirler 350 in fluid communication therewith. The air swirlers 350 are single-inlet air swirlers defined in the main upstream surface of main section 344. Between adjacent swirlers 350 there is a land 352 formed in the main upstream surface of main section 344. Swirlers 350 are radially offset with respect to the respective outlet orifices 346 and 348 to induce swirl on air flowing therethrough. An inboard air scoop 354 and an outboard air scoop 356 extend generally upstream from main section 344 to function as air inlets by diverting airflow from the inner and outer air circuits of injector 300, respectively, into swirlers 350.

Figure 36:
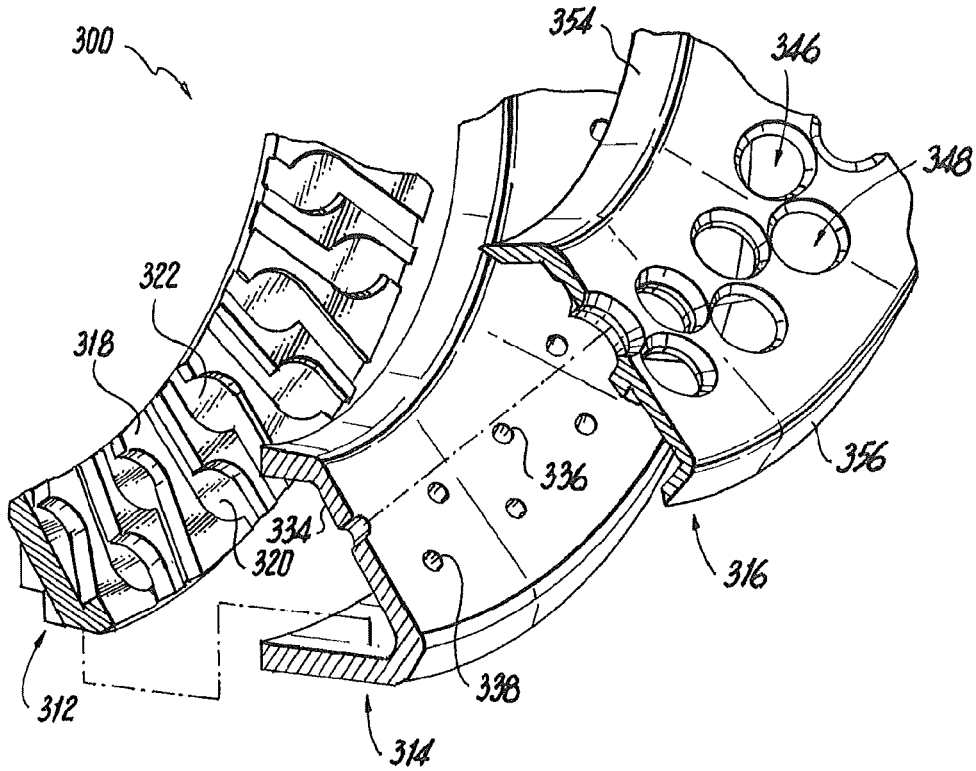
FIG. 36 is an exploded cross-sectional perspective view of a portion of the injector of FIG. 29, indicating the engagement of the distributor ring, fuel orifice ring, and air swirler ring as viewed from a downstream position.
Figure 37:
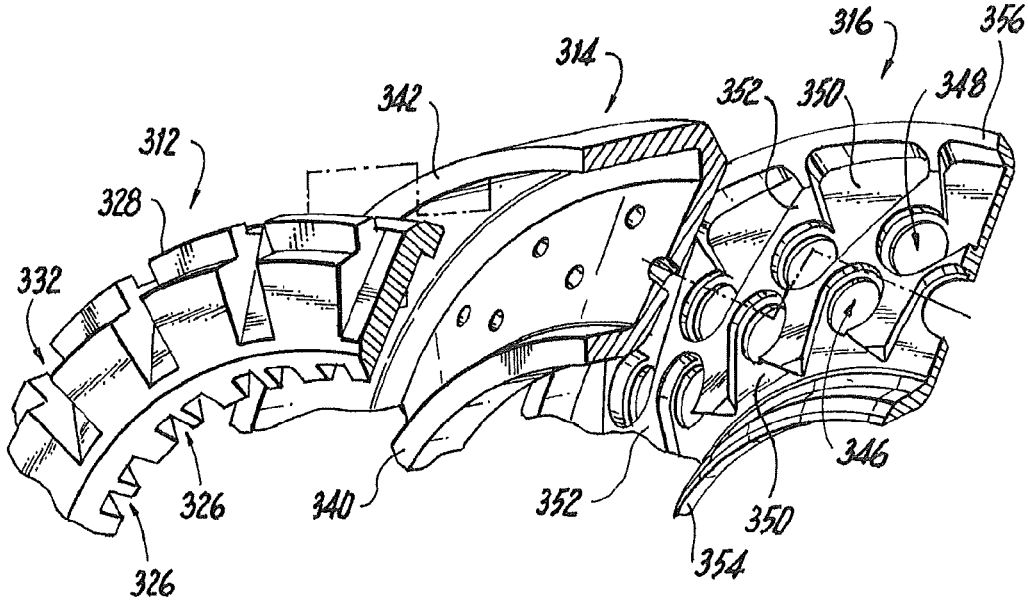
FIG. 37 is an exploded cross-sectional perspective view of a portion of the injector of FIG. 29, indicating the engagement of the distributor ring, fuel orifice ring, and air swirler ring as viewed from an upstream position.

Referring now to FIGS. 36 and 37, the engagement of distributor ring 312, fuel orifice ring 314, and air swirler ring 316 is indicated as viewed from points downstream and upstream respectively. The downstream face 318 of distributor ring 312 is mounted to the upstream surface of section 344 of fuel orifice ring 314. The outer circumference 328 of distributor ring 312 engages outboard flange 342 of fuel orifice ring 314. The gaps 332 allow for fuel flow to the swirlers 320 and 322 of distributor ring 312, as described above. There is a clearance between inboard flange 340 of fuel orifice ring 314 and the inboard fuel inlets 326 of distributor ring 312 to allow fuel to flow into inlets 326. Distributor ring 312 and fuel orifice ring 314 are mounted so that each respective swirler 322 and 320 is aligned with a respective fuel orifice 336 and 338. Land 352 of air swirler ring 316 is mounted to the downstream surface of main section 344 of fuel orifice ring 314. Air swirler ring 316 is mounted to fuel orifice ring 314, oriented so that each respective outlet orifice 346 and 348 of air swirler ring 316 is aligned with a respective fuel orifice 336 and 338. This positioning of air swirler ring 316 allows clearance between air scoop 354 and inboard flange 340, as well as between air scoop 356 and outboard flange 342 so that air can be supplied to air swirlers 350 for air-assisted injection of fuel from fuel orifices 336 and 338.

Figure 38:
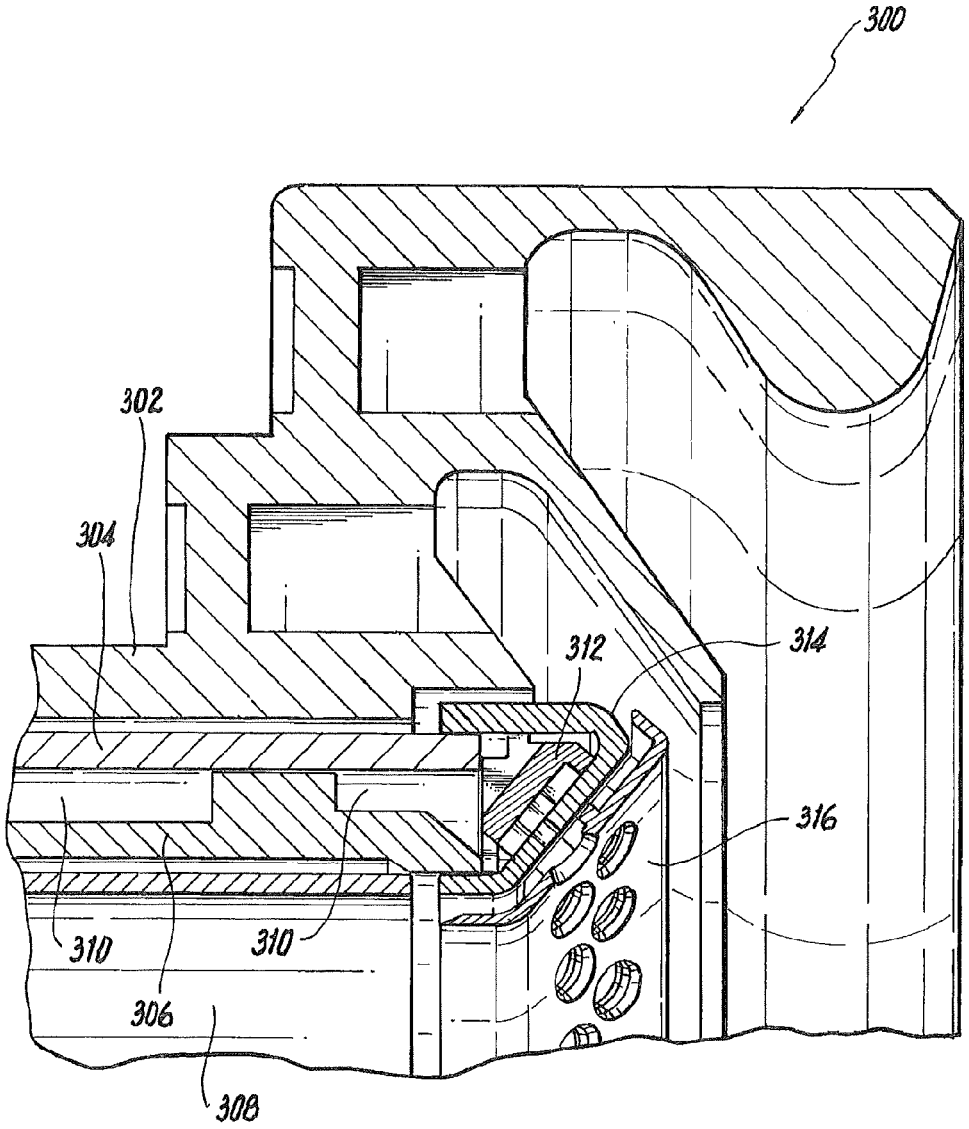
FIG. 38 is a cross-sectional elevation view of a portion of the injector of FIG. 29, showing the distributor ring, fuel orifice ring, and air swirler ring mounted to the injector.
Figure 39:
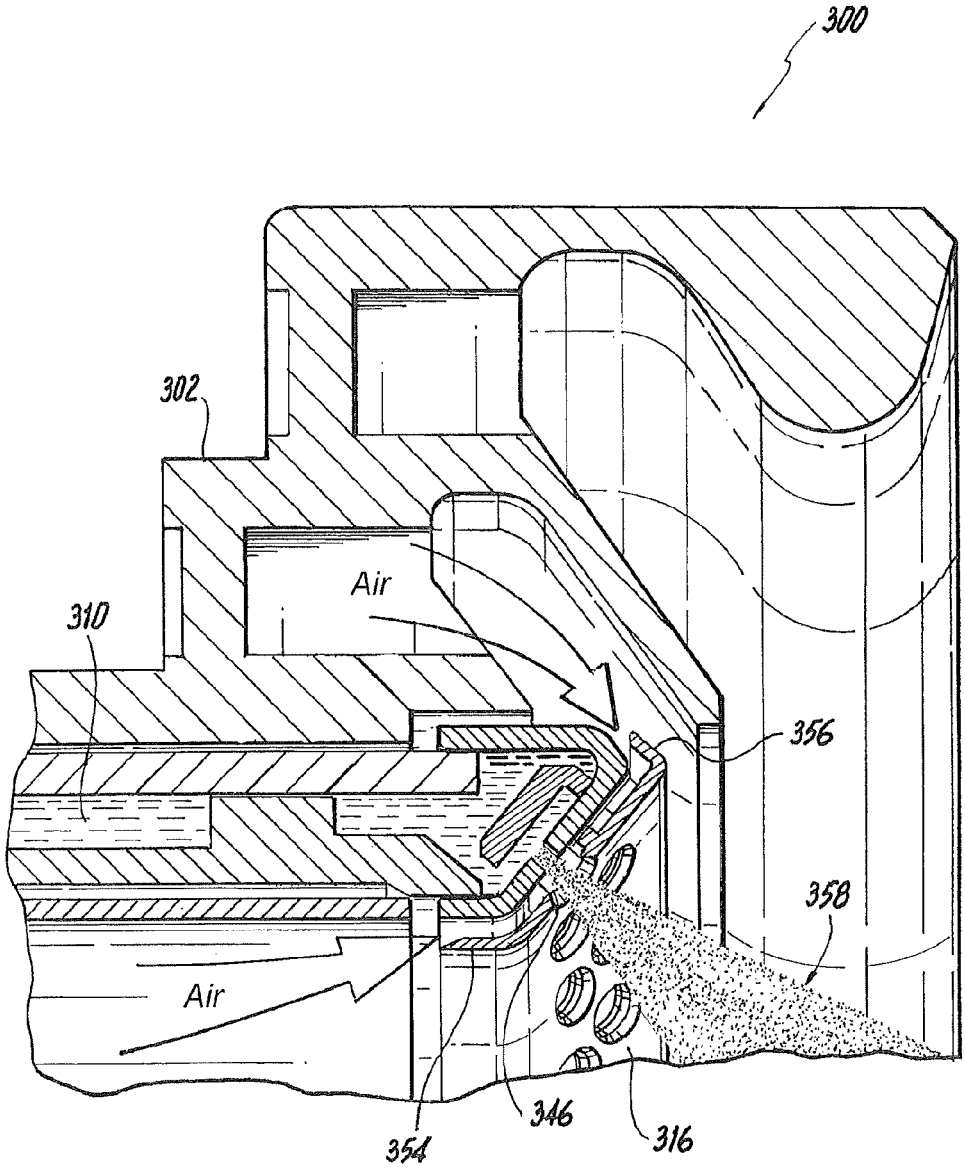
FIG. 39 is a cross-sectional elevation view of the injector of FIG. 38, schematically showing the fuel circuit filled with fuel, and schematically showing a spray of fuel from one of the fuel orifices.

With reference now to FIGS. 38 and 39, the outlet portion of injector 300 is shown with the multipoint modification. As shown in FIG. 38, the assembly of distributor ring 312, fuel orifice ring 314, and air swirler ring 316 is engaged to injector 300 by mounting fuel orifice ring 314 to prefilmer 304 and fuel swirler 306 as described above. In this manner, fuel orifice ring 314 seals of the downstream end of fuel circuit 310 so that fuel must pass through fuel swirlers 322 and 320 and on through fuel orifices 336 and 338 in order to reach the combustor downstream. With these modifications, prefilmer 304 and fuel swirler 306 serve as the inner and outer fuel sleeves for modified injector 300. FIG. 39 schematically indicates fuel and airflow through the modified portion of injector 300. Fuel from fuel circuit 310 and air from the inner and outer air circuits of injector 300, indicated by arrows in FIG. 39, produce an air-assisted lean direct injection spray 358. For sake of clarity, spray 358 is only indicated for one injection point in FIG. 39, however, it is intended that all of the injection points produce a spray simultaneously.

Figure 40:
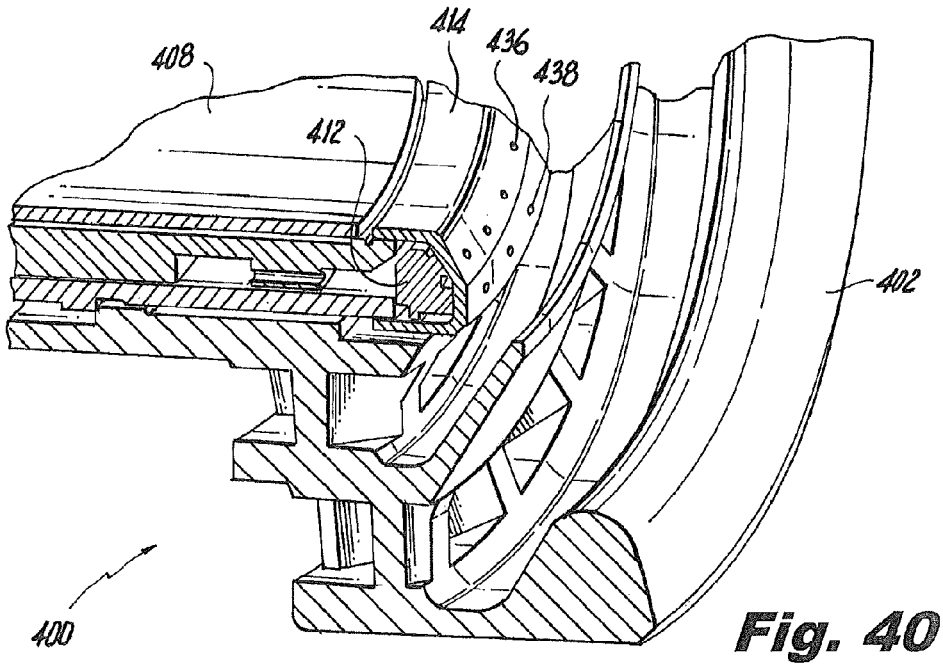
FIG. 40 is a cross-sectional perspective view of another exemplary embodiment of an injector constructed in accordance with the present invention, showing a multipoint injector without any air-assist air swirlers.
Figure 41:
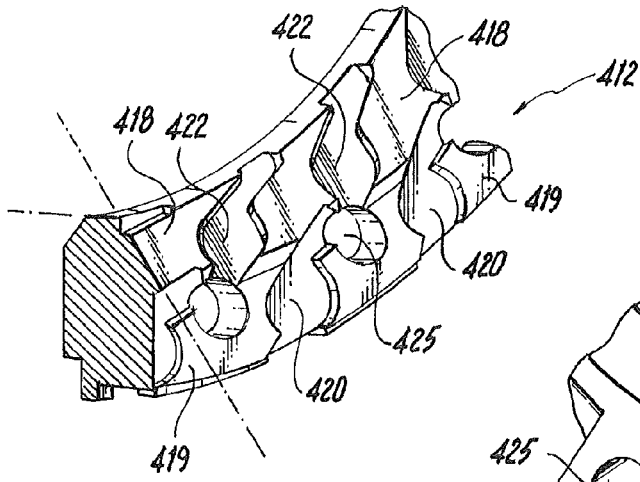
FIG. 41 is a cross-sectional perspective view of a portion of the injector of FIG. 40, showing a section of the distributor ring as viewed from downstream.
Figure 42:
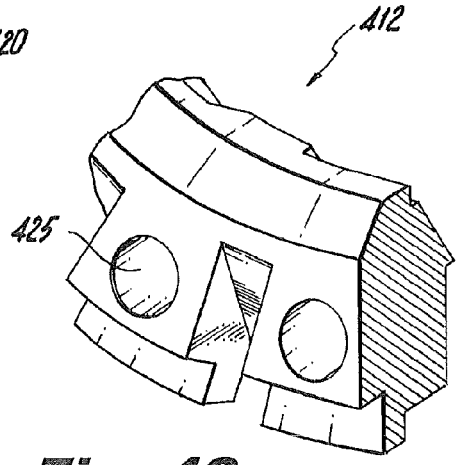
FIG. 42 is a cross-sectional perspective view of a portion of the injector of FIG. 40, showing a section of the distributor ring as viewed from upstream.

In certain applications where air-assisted injection is not needed, it is possible to dispense with individual air swirlers for each injection point. Referring now to FIGS. 40-42, another exemplary embodiment of an injector 400 is shown. Injector 400 is similar in most aspects to injector 300 described above, including outer air swirler 402 and inner air swirler 408. However, injector 400 does not include a multipoint air swirler ring. Rather, the swirlers and fluid outlets are configured and adapted to inject a swirling, pressure atomized spray of fuel therefrom. Injector 400 thus provides for multipoint lean direct injection without individualized assist air for each injection point. An additional difference between injector 400 and injector 300 described above is the shape of the respective distributor rings and fuel orifice rings. As can be seen in FIG. 40, distributor ring 412 and fuel orifice ring 414 are shaped so that inboard fuel orifices 436 are directed to a radially converging direction and outboard fuel orifices 438 are directed axially downstream, i.e., fuel orifices 438 do not converge or diverge. As shown in FIGS. 41 and 42, where distributor ring 412 is shown from a point downstream and a point upstream, respectively, distributor ring 412 includes through bores 425 for feeding the outboard inlets of inboard swirlers 422 and the inboard inlets of outboard swirlers 420. Swirlers 420 are defined in an axially downstream facing surface 419, and swirlers 422 are defined in a frustoconical surface 418 to engage the interior downstream facing and frustoconical surfaces of fuel orifice ring 414.

Figure 43:
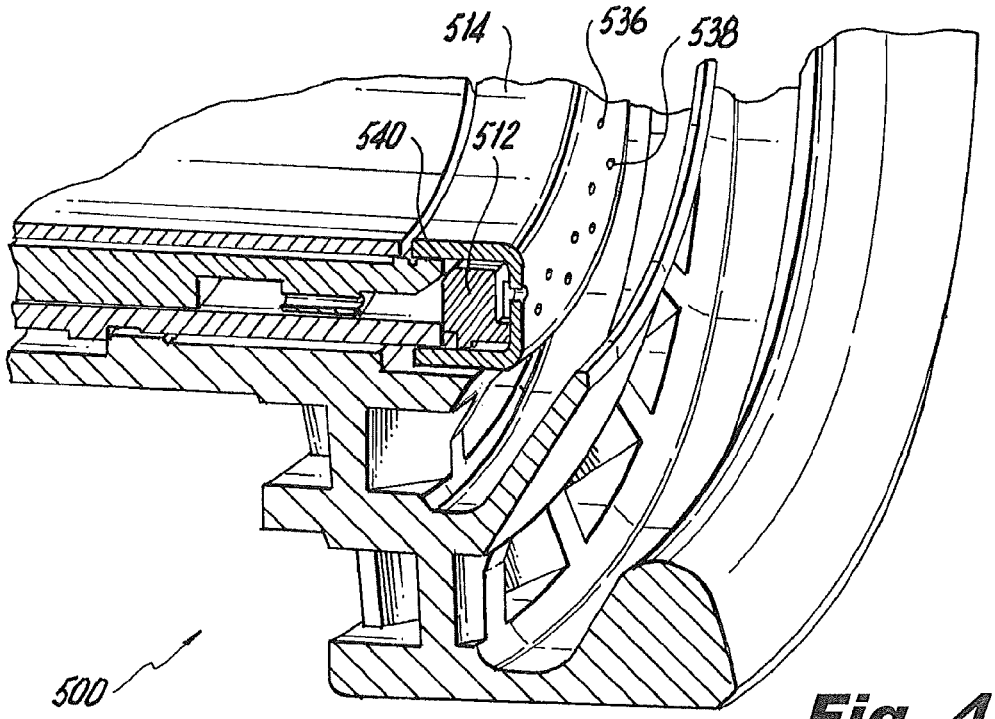
FIG. 43 is a cross-sectional perspective view of another exemplary embodiment of an injector constructed in accordance with the present invention, showing a multipoint injector without any air-assist air swirlers, in which the fuel orifices are all directed axially downstream.
Figure 44:
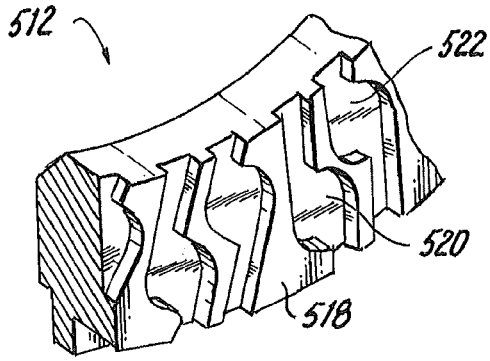
FIG. 44 is a cross-sectional perspective view of a portion of the injector of FIG. 43, showing a section of the distributor ring as viewed from downstream.
Figure 45:
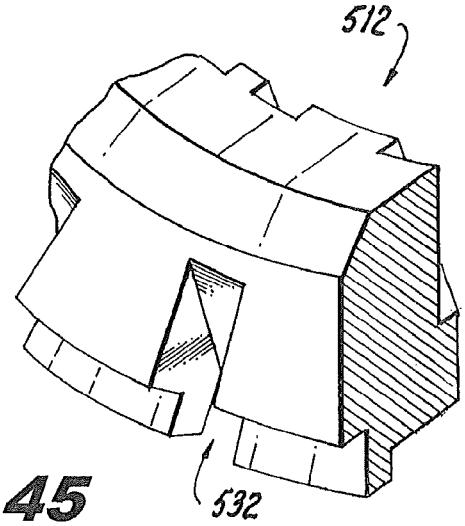
FIG. 45 is a cross-sectional perspective view of a portion of the injector of FIG. 43, showing a section of the distributor ring as viewed from upstream.

Referring now to FIGS. 43-45, another exemplary embodiment of an injector 500 is shown. Injector 500 is similar in most respects to injector 400 described above. However, distributor ring 512 and fuel orifice ring 514 are configured so that all of the fuel orifices 536 and 538 are directed in an axially downstream direction. As shown in FIG. 44, all of the fuel swirlers 522 and 520 are formed in a surface 518 of distributor ring 512 that faces axially downstream. As shown in FIGS. 43 and 45, through bores, such as through bores 425 described above, are not required because all of the outboard inlets for fuel swirlers 520 and 522 can be fed with fuel passing through gaps 532, and all of the inboard inlets can be fed with fuel passing through clearance provided between inboard flange 540 of fuel orifice ring 514 and distributor ring 512, much as described above with respect to injector 300.

While injectors 400 and 500 are described above in the exemplary context of no air-assist, those skilled in the art will readily appreciate that air swirler rings, like air swirler ring 316 described above, can be added to injectors 400 and 500 for applications where air-assist is advantageous. Injectors 300, 400 and 500 are advantageously configured so that the largest pressure drop in the multipoint fuel circuit occurs at the fuel orifices. In retrofit applications, this can be accomplished by opening or widening the metering slots of the original, unmodified design if necessary.

The multipoint configurations described herein allow for control of location and orientation of injection, as well as the ability to intersperse air and fuel inlets, enabling very rapid mixing and more flexibility to control the flow field. The ability to deliberately direct the fuel to create a desired pattern is a distinct advantage over a prefilming airblast injector, which is mostly dependent on the air flow field to influence fuel dispersion. With this advantage, the multipoint configurations described herein still retain the advantage of a stabilizing, dominant, swirling air flow field typical of airblast injectors. Moreover, the multipoint configurations described herein provide for the benefits of lean direct injection and air-assisted lean direct injection without the need to alter the form factor or envelope of existing air blast fuel injectors. Additional benefits of multipoint injectors integrated with a traditional engine architecture in accordance with the invention, as opposed to traditional multipoint arrays of small injectors, include simpler heat management, neutral weight gain (compared to air blast injectors), simplified construction, and the option to retrofit existing engines. While described above with exemplary numbers of injection points, any suitable number of individual injection points can be used from application to application without departing from the invention.

While described in the exemplary context of fuel injectors for gas turbine engines, those skilled in the art will readily appreciate that multipoint injectors in accordance with the invention can be practiced in any other suitable spray application. Other suitable applications include (but are not limited to) fuel cell reformers, fire suppression, misting, and rich burn applications. Exemplary embodiments have been described above with air-assisted injection, however, any suitable gas can be used for gas assisted injection in accordance with the invention. The exemplary injectors described herein can be constructed using conventional machining practices without etching or macro laminate, however those skilled in the art will readily appreciate that any suitable processes can be used to construct injectors as described above without departing from the spirit and scope of the invention.

Figure 46:
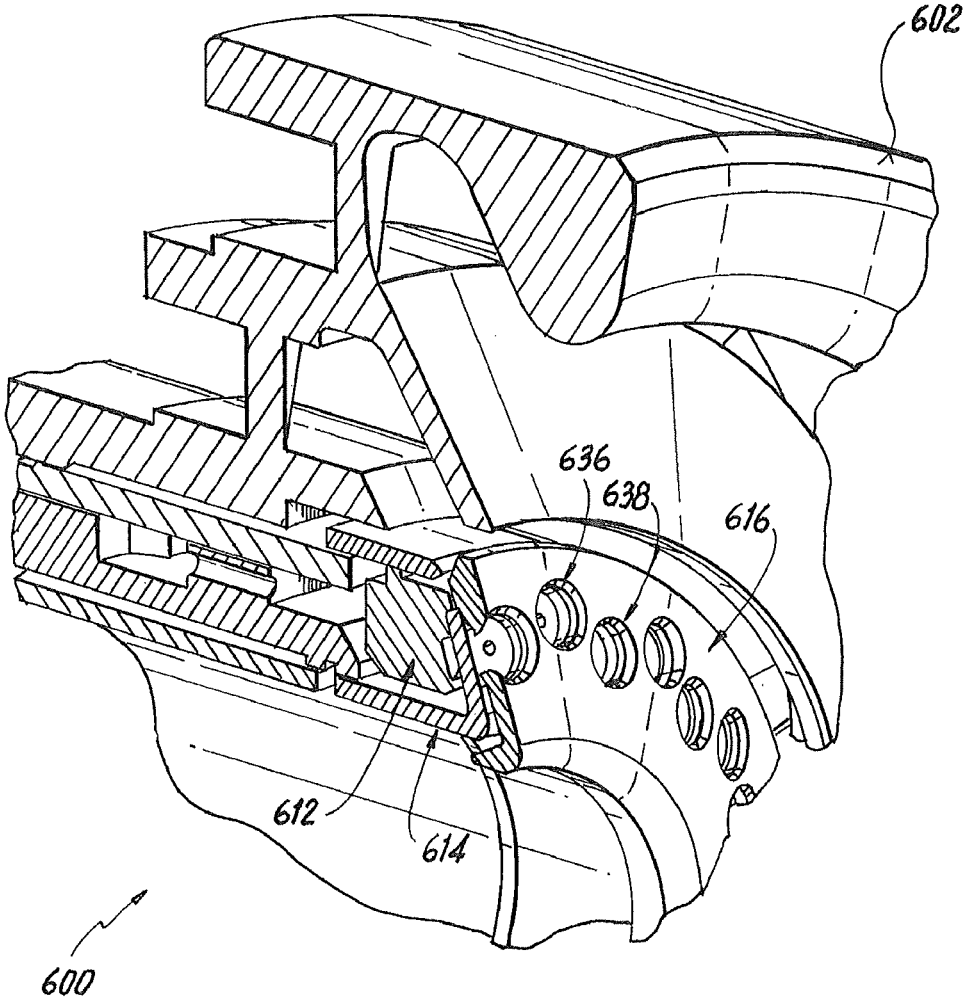
FIG. 46 is a cross-sectional perspective view of another exemplary embodiment of an injector constructed in accordance with the present invention, showing a multipoint injector with diverging outlets.

The multipoint injection described above includes injection points that converge axially, or that are aligned axially. However, it is also contemplated that some or all of the injection points can have spray directions that diverge from the axial direction. Referring now to FIGS. 46-49, another exemplary embodiment of a fuel injector 600 is shown, in which the spray direction diverges from the central axis. As shown in FIG. 46, injector 600 includes a distributor ring 612, fuel orifice ring 614, and air swirler ring 616 much like those described above, however, these three rings are configured so that all of the fuel and air outlets diverge away from the central axis of injector 600. Distributor ring 612, shown in FIG. 47, includes inboard and outboard swirlers 620 and 622 defined in diverging down stream face 618, all of which define a diverging downstream aspect for distributor ring 612. The upstream portion of distributor ring 612, shown in FIG. 48, includes features similar to distributor ring 312 described above, including gaps 632 for passage of fuel around distributor ring 612. Referring again to FIG. 46, air swirler ring 616 includes inboard and outboard orifices 638 and 636, respectively, much as described above. The upstream aspect of air swirler ring 616, shown in FIG. 49, includes air swirlers 650 which operate much as air swirlers 350 described above, with the outboard inlets into swirlers 650 being open to receive air in a generally radial direction from outboard thereof. Since the components of injector 600 are configured do inject a multipoint spray of fuel and air in a diverging direction toward the converging flow form the outer air swirler 602, shown in FIG. 46, the interaction of the converging outer air flow with the diverging flow of air and fuel can provide enhanced fuel distribution and atomization.

The methods and systems of the present invention, as described above and shown in the drawings, provide for multipoint swirl stabilized discrete injection atomization. Mechanical features are incorporated to atomize fuel, therefore the methods and systems of the present invention avoid the disadvantages of relying on air for atomization as in a jet in cross flow. Lean direct injection, with optional air assist provided at each injection point enables more efficient combustion and lower emissions. Also, staging of fuel circuits for improved turndown ratios is more easily accomplished than in air blast injectors. The benefits of multipoint injection are added to the benefits of the stability provided by a central recirculation zone as in airblast injectors, rather than on numerous individual distributed zones. The exemplary configurations can be fit into the form envelopes of airblast fuel injectors. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A multipoint injector ring comprising:

a) a distributor ring defining a central axis and having a fluid inlet and a plurality of swirlers in fluid communication with the fluid inlet for imparting swirl on fluid from the fluid inlet, wherein the swirlers are defined in a downstream surface of the distributor ring; and b) an orifice ring mounted to the distributor ring, the orifice ring defining a plurality of fluid outlets circumferentially spaced apart with respect to the central axis, wherein each fluid outlet is aligned downstream of a respective swirler for injecting swirling fluid from the swirlers in a downstream direction, wherein an air circuit is defined from the fluid inlet, through the swirlers to the fluid outlets, and further comprising a fuel circuit including a plurality of fuel swirl chambers defined in an upstream surface of the distributor ring for imparting swirl onto a flow of fuel passing therethrough, with a fuel outlet orifice in fluid communication with each respective fuel swirl chamber, each fuel outlet orifice passing through the distributor ring from the respective fuel swirl chamber to a downstream surface of the distributor ring, with each fuel outlet orifice aligned with a respective one of the swirlers of the air circuit for injecting a swirling flow of fuel and air for air-assisted injection of fuel.

2. A multipoint injector ring as recited in claim 1, wherein a fuel circuit is defined from the fluid inlet, through the swirlers to the fluid outlets, wherein the swirlers and fluid outlets are configured and adapted to inject a swirling, pressure atomized spray of fuel therefrom.

3. A multipoint injector ring as recited in claim 2, further comprising an air swirler ring mounted proximate the orifice ring, wherein the air swirler ring defines a plurality of air swirlers in an upstream facing surface thereof, with an air outlet defined through the air swirler ring in fluid communication with each respective air swirler, wherein each air outlet is aligned downstream of a respective fluid outlet of the orifice ring to impart swirl on a flow of air to assist atomization of fuel from each fluid outlet.

4. A multipoint injector ring as recited in claim 3, wherein the air swirler ring includes an inboard air inlet in fluid communication with the air swirlers for providing a flow of air from a radially inboard source.

5. A multipoint injector ring as recited in claim 3, wherein the air swirler ring includes an outboard air inlet in fluid communication with the air swirlers for providing a flow of air from a radially outboard source.

6. A multipoint injector ring as recited in claim 1, wherein the orifice ring includes an inboard air inlet in fluid communication with the swirlers of the air circuit for providing a flow of air from a radially inboard source, and an outboard air inlet in fluid communication with the swirlers of the air circuit for providing a flow of air from a radially outboard source.

* * * * *